US011744357B2

(12) United States Patent
Langenegger et al.

(10) Patent No.: US 11,744,357 B2
(45) Date of Patent: Sep. 5, 2023

(54) HOUSEHOLD BRUSH OR HYGIENE BRUSH DEVICE

(71) Applicant: TRISA HOLDING AG, Triengen Luzern (CH)

(72) Inventors: Peter Langenegger, Uznach St. Gallen (CH); Pius Thoma, Gommiswald St. Gallen (CH)

(73) Assignee: TRISA HOLDING AG, Triengen Luzern (CH)

( * ) Notice: Subject to any disclaimer, the term of this patent is extended or adjusted under 35 U.S.C. 154(b) by 256 days.

(21) Appl. No.: 17/102,632

(22) Filed: Nov. 24, 2020

(65) Prior Publication Data

US 2021/0076811 A1 Mar. 18, 2021

Related U.S. Application Data

(63) Continuation of application No. 16/076,883, filed as application No. PCT/EP2017/052767 on Feb. 8, 2017, now Pat. No. 10,874,204.

(30) Foreign Application Priority Data

Feb. 10, 2016 (EP) ..... 16155034

(51) Int. Cl.
*A46B 9/02* (2006.01)
*A46D 1/00* (2006.01)

(52) U.S. Cl.
CPC ..... *A46B 9/028* (2013.01); *A46D 1/0276* (2013.01); *A46D 1/0238* (2013.01)

(58) Field of Classification Search
CPC ..... A46B 9/02; A46B 9/028; A46B 1/0238; A46D 1/0276
See application file for complete search history.

(56) References Cited

U.S. PATENT DOCUMENTS

| | | | | |
|---|---|---|---|---|
| 10,743,647 | B2 * | 8/2020 | Xi | A46B 9/04 |
| 2003/0163884 | A1 | 9/2003 | Weihrauch | |
| 2004/0011375 | A1 | 1/2004 | Dumler | |
| 2009/0013488 | A1 | 1/2009 | Sakurai et al. | |
| 2010/0223745 | A1 | 9/2010 | Kraemer et al. | |
| 2010/0223746 | A1 | 9/2010 | Mueller | |
| 2011/0185528 | A1 | 8/2011 | Befve et al. | |
| 2014/0373871 | A1 | 12/2014 | Chang | |
| 2015/0065927 | A1 | 3/2015 | Brewer et al. | |

(Continued)

FOREIGN PATENT DOCUMENTS

| | | | |
|---|---|---|---|
| CN | 102245052 | A | 11/2011 |
| DE | 102 32 589 | A1 | 1/2004 |
| EP | 1774924 | A1 | 4/2007 |

(Continued)

OTHER PUBLICATIONS

Feb. 24, 2021 Office Action issued in Chinese Patent Application No. 201780022692.1.

(Continued)

*Primary Examiner* — Shay Karls
(74) *Attorney, Agent, or Firm* — Oliff PLC

(57) ABSTRACT

A household brush or hygiene brush device has at least one brush application region comprising at least one first bristle end zone and at least one second bristle end zone, wherein the second bristle end zone is implemented differing from the first bristle end zone.

19 Claims, 15 Drawing Sheets

(56) References Cited

U.S. PATENT DOCUMENTS

Figure 1:
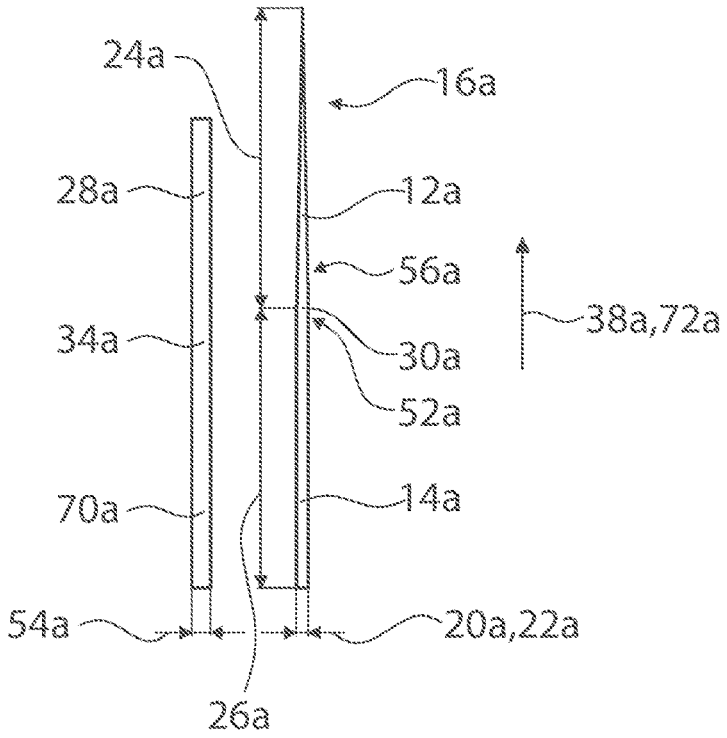

2015/0135456 A1 5/2015 Kirchhofer et al.

FOREIGN PATENT DOCUMENTS

| | | | | |
|---|---|---|---|---|
| EP | 2682022 | A1 | 1/2014 | |
| EP | 2605683 | B1 * | 9/2019 | ..... A46B 3/06 |
| WO | 2015/076379 | A1 | 5/2015 | |
| WO | WO-2018085484 | A1 * | 5/2018 | ..... A46B 13/02 |

OTHER PUBLICATIONS

Dec. 15, 2020 Office Action issued in European Patent Application No. 16 155 034.8.

English Summary of Jan. 13, 2020 Office Action issued in Chinese Patent Application No. 201780022692.1.

EP Search Report dated Aug. 2, 2018 issued in corresponding EP patent application No. 16155034.8 (and partial translation thereof).

International Preliminary Report on Patentability dated Aug. 14, 2018 issued in corresponding international patent application No. PCT/EP2017/052767.

International Search Report dated Aug. May 10, 2017 issued in corresponding international patent application No. PCT/EP2017/052767.

May 10, 2021 Office Action issued in European Patent Application No. 17705066.3.

* cited by examiner

HOUSEHOLD BRUSH OR HYGIENE BRUSH DEVICE

This application is a continuation application of U.S. application Ser. No. 16/076,883, filed Aug. 9, 2018, which is a national stage entry of PCT/EP2017/052767, filed Feb. 8, 2017, and which claims priority to EP 16155034.8, filed Feb. 10, 2016. The disclosures of each of the aforementioned references are hereby incorporated by reference in their entireties.

STATE OF THE ART

The invention relates to a household brush device or hygiene brush device according to the preamble of claim 1.

Household or hygiene brushes with bristle bundles implemented of bristles of the same type, which are anchored in a brush head by means of metal anchors, have already been proposed. Moreover, in particular household brushes with natural bristles are known, which often have more favorable cleaning characteristics than household brushes with synthetic bristles.

The objective of the invention is in particular to provide a generic household brush or hygiene brush device with improved characteristics regarding a cleaning efficiency, in particular in a household or bodycare context. The objective is achieved according to the invention by the features of patent claim 1 while advantageous implementations and further developments may be gathered from the subclaims.

Advantages of the Invention

The invention is based on a household brush or hygiene brush device with at least one brush application region comprising at least one first bristle end zone and at least one second bristle end zone.

It is proposed that the second bristle end zone is implemented differing from the first bristle end zone.

"Configured" is in particular to mean specifically designed and/or equipped. By an object being configured for a certain function is in particular to be understood that the object fulfills and/or implements said certain function in at least one application state and/or operating state. A "household brush or hygiene brush device" is in particular to mean a component, in particular a working component, in particular a structural and/or functional component, of a household brush or hygiene brush, advantageously an oral-hygiene brush, for example a vegetable brush, a dishwashing brush, a washing-up brush, a bottle brush, a hairbrush, a face brush, a toothbrush, an interdental brush, a tongue brush, a beard brush, a toilet brush, a wire brush, a nailbrush, a shoe brush, a pipe-cleaning brush, a scrubber, a broom, a hoover brush, or a hand broom. Advantageously the household brush or hygiene brush device is configured for cleaning, in particular mechanical and/or dry and/or wet cleaning, in particular of a surface, advantageously by brushing and/or swiping. Especially advantageously the household brush or hygiene brush device is configured to move and/or take up and/or remove, in a cleaning process, dirt and/or dust and/or filth and/or sediments. Beyond this it is also conceivable that a specifically adapted household brush or hygiene brush device could be part of a face brush, of a bath brush, of a cosmetic brush, e.g. for nail polish or mascara or makeup, of a cosmetics applicator (i.e. a brush to apply cosmetic products), e.g. a hair color applicator or another type of fluid applicator, a shaving brush, a medical applicator, or a brush for cleaning a razor device or a depilating device. Advantageously the household brush or hygiene brush device is part of an oral-hygiene brush like, for example, a toothbrush, an interdental cleaner, a tongue cleaner or the like. It is in particular conceivable that the household brush or hygiene brush device constitutes a toothbrush device, an interdental cleaner device or a tongue brush device. All the mentioned household brush or hygiene brush devices are also operable motorically. This preferably constitutes an electrical drive with a velocity of 1,000-30,000 rpm, preferably 3,000-25,000 rpm, particularly preferably 4,000-20,000 rpm. In particular, the household brush or hygiene brush device may comprise an oscillating drive with a maximum bristle tip deflection of 10 mm, preferably 7 mm and especially preferentially 5 mm. In particular, a drive of the household brush or hygiene brush device generates an oscillating rotational movement around an axis that is substantially perpendicular to a bristle accommodation region or a partial region thereof, with a maximum rotation angle of 50°, preferably maximally 15°, particularly preferably between 3° and 12°, and/or an oscillating rotational movement around an axis that is substantially parallel to the bristle accommodation region or a partial region thereof, with a maximum rotation angle of 50°, preferably maximally 15°, particularly preferably between 3° and 12°, and/or a continuous rotational movement around an axis that is substantially perpendicular to the bristle accommodation region or a partial region thereof, and/or a continuous rotational movement around an axis that is substantially parallel to the bristle accommodation region or a partial region thereof. It has been shown that a service life and a cleaning performance of the above-mentioned household brush or hygiene brush device provide the best performance and service life in the velocity ranges and angle ranges given above.

By a "brush application region" is in particular a region to be understood which, in a usage of the household brush or hygiene brush device, comes, at least partially, preferably uniformly and in particular simultaneously, into contact with an object that is to be cleaned, in particular a body part. Advantageously the brush application region comprises a plurality of first bristle end zones and/or a plurality of second bristle end zones. In particular, the household brush or hygiene brush device comprises at least one brush head with the brush application region. The brush head may, for example, be manufactured at least partially of wood, in particular beech and/or ash and/or bamboo. Advantageously the brush head is manufactured at least partly, especially advantageously at least to a large extent, of a synthetic material or of a plurality of synthetic materials. The brush head that is made of synthetics preferentially comprises at least one hard component to implement a carrier body for the further elements (synthetics, bristles, etc.).

A synthetic material may be a hard component, for example a synthetic material from the field of thermoplastics, e.g. a hard plastic constituted by a styrene polymerisate like, for example, styrene acrylonitrile (SAN) or polystyrene (PS) or acrylonitrile butadiene styrene (ABS) or styrene methyl methacrylate (SMMA) or styrene butadiene (SB), and/or a polyolefin like, for example, polypropylene (PP) or a polyethylene (PE), in particular high-density or low-density polyethylene (HDPE/LDPE), and/or a polyester like, for example, in particular acid-modified or glycol-modified, polyethylene terephthalate (PETA/PETG) or polybutylene terephthalate (PBT) or acid-modified polycyclohexylene dimethylene terephthalate (PCT-A) or glycol-modified polycyclohexylene dimethylene terephthalate (PCT-G), and/or a cellulose derivate, e.g. cellulose acetate (CA) or cellulose acetobutyrate (CAB) or cellulose propionate (CP) or cellulose acetate phthalate (CAP) or cellulose butyral (CB), and/or a polyamide (PA), like PA 6.6 or PA 6.10 or PA 6.12, and/or poly (methylmethacrylate) (PMMA) and/or polycarbonate (PC), and/or polyoxymethylene (POM) and/or polyvinyl chloride (PVC) and/or polyurethane (PUR).

The brush head may furthermore be manufactured at least partially of a soft component, e.g. a soft synthetic material. As a soft synthetic material from the field of thermoplastics may generally, for example, the following find usage: a thermoplastic elastomer like, for example, a thermoplastic polyurethane elastomer (TPE-U), a thermoplastic styrene elastomer (TPE-S) like, for example, a styrene-ethylene-butylene-styrene copolymer (SEBS) or a styrene-butadiene-styrene copolymer (SBS), and/or a thermoplastic polyamide elastomer (TPE-A) and/or a thermoplastic polyolefin elastomer (TPE-O) and/or a thermoplastic polyester elastomer (TPE-E). The brush head preferably comprises at least one hard component, in particular at least as part of a base body, with an elastic modulus between 1000 $N*mm^{-2}$ and 2400 $N*mm^{-2}$, and especially preferentially between 1300 $N*mm^{-2}$ and 1800 $N*mm^{-2}$, in particular preferably a polypropylene. The brush head may further in particular comprise at least one soft component, in particular at least as part of a handle region, with an elasticity modulus between 10 $N*mm^{-2}$ and 1000 $N*mm^{-2}$, advantageously between 50 $N*mm^{-2}$ and 200 $N*mm^{-2}$. A Shore A hardness of the soft component is advantageously less than 200, especially advantageously less than 90. Preferentially a TPE-S is used as a soft component. Particularly preferentially at least a brush head blank is produced in an injection-molding procedure, the respective hard and/or soft components preferentially respectively realizing a substance-to-substance bond after molding of the soft component onto the hard component; it is however also conceivable to realize a geometric design of the bodies in such a way that the components are connected by a form-fit connection (with or without substance-to-substance bond). The term "at least to a large extent" is here in particular to mean at least by 55%, advantageously at least by 65%, preferably at least by 75%, particularly preferably at least by 85% and especially advantageously at least by 95%.

By a "bristle end zone" is in particular a continuous, in particular filament-like, portion of a bristle to be understood, extending in particular from a free end point of the bristle end zone up to a point of a bristle fixation zone of the bristle end zone that is the farthest away from the free end point, the bristle end zone being in particular fixated in said bristle fixation zone. A length of the bristle end zone corresponds to a distance, along a course of the bristle end zone, between the free end point and the farthest point. In particular, in a cleaning process, the free end point is in contact with the object that is to be cleaned. Advantageously the free end point is arranged on a side of the bristle end zone that faces away from the brush head. Preferably the bristle fixation zone is arranged at least partly in a bundle accommodation of the brush application region. Particularly preferably the bristle end zone comprises a bristle application region which is arranged outside a bundle accommodation of the brush application region. Advantageously the bristle application region and the bristle fixation zone implement the bristle end zone. Advantageously at least one of the bristle end zones is implemented to be bendable, in particular bendable perpendicularly to a main extension direction of the bristle end zone. Preferentially at least one of the bristle end zones has a length which is greater than a maximum thickness of the respective bristle end zone at least by a factor of 10, advantageously at least by a factor of 100, especially advantageously at least by a factor of 500. In particular, at least one of the bristle end zones has a length which is between 1 mm and 200 mm, advantageously between 5 mm and 150 mm and particularly advantageously between 10 mm and 100 mm. If the household brush or hygiene brush device is, for example, part of a dish-washing brush or a washing-up brush or a toilet brush or a scrubber, advantageously at least one of the bristle end zones has a length which is between 5 mm and 100 mm, especially advantageously between 10 mm and 60 mm and preferably between 20 mm and 40 mm. If the household brush or hygiene brush device is, for example, part of a broom or a hand broom, advantageously at least one of the bristle end zones has a length which is between 10 mm and 200 mm, especially advantageously between 40 mm and 100 mm and preferably between 40 mm and 80 mm. If the household brush or hygiene brush device is, for example, part of a face brush or an oral-hygiene brush like a toothbrush, an interdental cleaner, a tongue brush or the like, advantageously at least one of the bristle end zones has a length which is between 5 mm and 30 mm, especially advantageously between 10 mm and 20 mm. "At least substantially parallel" is herein in particular to mean an orientation of a direction relative to a reference direction, in particular in a plane, wherein the direction has a deviation from the reference direction that is in particular less than 8°, advantageously less than 5° and especially advantageously less than 2°. By a "main extension direction" of an object is herein in particular a direction to be understood which extends in parallel to a largest edge of a smallest imaginary rectangular cuboid which just still entirely encloses the object.

Preferably the first bristle end zone and the second bristle end zone feature differing cross section courses, in particular along a main extension direction of the respective bristle end zone. Advantageously at least one of the bristle end zones has, along the main extension direction of the bristle end zone, a cross section which is, at least section-wise, at least substantially constant in particular in the main extension direction. For example, at least one of the bristle end zones has an at least substantially ellipse-shaped, a substantially circular or polygonal cross section. Preferentially a cross section of the first bristle end zone differs from a cross section of the second bristle end zone. In particular, at least one of the bristle end zones has a maximum diameter between 0.01 mm and 2 mm, advantageously between 0.05 mm and 0.5 mm and especially advantageously between 0.10 mm and 0.3 mm. Preferably at least one of the bristle end zones is produced in an extrusion procedure and is in particular cut to length after extrusion. Particularly preferably for household brush devices, at least one of the bristle end zones has, subsequently to a cutting-to-size, a non-machined end. Hygiene brushes like face brushes, toothbrushes or similar are preferably further machined subsequently to the cutting-to-size (they are, for example, rounded off by mechanical procedures). By an "at least substantially constant cross section" of an object is herein in particular to be understood that, for any first cross section of the object along at least one direction and any second cross section of the object along the direction, a minimum area content of a differential area, which is realized by laying one of the cross sections over the other one, is maximally 20%, advantageously maximally 10%, especially advantageously no more than 5% of the area content of the larger cross section of the two. By an "at least substantially ellipse-shaped cross section" of an object is herein in particular to be understood that, for at least 60%, advantageously for at least 70%, particularly advantageously for at least 80% and preferably for at least 90% of all cross sections of the object along at least one direction, an area content of a differential area of the cross section and a smallest ellipse encompassing the cross section is maximally 30%, advantageously no more than 20%, especially advantageously no more than 10% and preferably maximally 5% of the area content of the ellipse. "Differing" is in particular to mean, in this context, implemented differently beyond deviations within a manufacturing tolerance.

It is conceivable that at least one of the bristle end zones is implemented undulate and/or wave-shaped. In particular, it is conceivable that a projection of at least one of the bristle end zones follows a course that is realized differing from a straight line. For example, at least one of the bristle end zones may follow a helical course. Advantageously the first bristle end zone features, at least section-wise, a different color than the second bristle end zone. The colored region may extend over the entire bristle end zone and/or over the entire bristle. In particular, a colored region of a respective bristle end zone may, in case of a partial coloring, have a length that is between 1 mm and 30 mm, advantageously between 5 mm and 15 mm and particularly advantageously between 7 mm and 9 mm. A minimum requirement for the used color is, in particular skin-compatibility, to make it advantageously applicable in the field of hygiene. The color may furthermore be realized as an indicator pigment, which is used up and/or fades with usage, thus indicating when the household or hygiene brush should be replaced. In particular, at least one of the bristle end zones has an abrasion resistance of maximally 300 mg/hr, advantageously no more than 200 mg/hr, especially advantageously no more than 100 mg/hr and preferably no more than 50 mg/hr. Advantageously at least one of the bristle end zones features, in particular at room temperature, a maximum water intake of no more than 10%, particularly advantageously no more than 5%, preferentially maximally 2%, preferably maximally 1% and particularly preferably maximally 0.5% of a volume of the bristle end zone. A "water intake" of an object is herein to mean a percentage of water entering the object, which is in particular realized differently from water adhering to a surface of the object. Preferably the first bristle end zone has a different rigidity, in particular a different flexural rigidity, than the second bristle end zone.

By an implementation according to the invention, in particular improved characteristics regarding a cleaning performance are achievable. It is advantageously possible to thoroughly clean uneven surfaces and/or surfaces having fissures and/or seams and/or interstices and/or corners and/or edges. Moreover, advantageously a household brush or hygiene brush device may be used for different application purposes with differing press-on pressures. Moreover, it is advantageously possible to provide a household brush or hygiene brush device that is adapted to a respective application and is in particular achievable in a cost-competitive manner. Furthermore, a high cost-efficiency and/or advantageous characteristics regarding simple manufacturing are/is achievable. Advantageously a high durability is achievable. Beyond this, advantageously a household brush or hygiene brush device suitable for wet-cleaning as well as for dry-cleaning may be rendered available. Moreover, improved characteristics are achievable in regard of gentle cleaning. Furthermore, it is advantageously possible to copy characteristics of household brushes with natural bristles. Furthermore advantageous characteristics are achievable regarding cleaning and/or grooming of body parts, in particular teeth and/or skin, e.g. facial skin. For example, dental interstices are reliably cleanable and/or reachable. An effective cleansing is also achievable in case of unevennesses, e.g. of a skin, of a tooth, of a nail or of another body part.

In an advantageous implementation of the invention it is proposed that at least one of the bristle end zones, preferably either the first one or the second one of the bristle end zones, comprises at least one tapering region. Advantageously one of the bristle end zones comprises a tapering region and the other bristle end zone has an at least substantially constant cross section. Preferentially a main extension direction of the tapering region extends at least substantially parallel to a main extension direction of the bristle end zone. Advantageously at least one of the bristle end zones has a cross section, the size of which diminishes in the tapering region monotonously and/or substantially linearly, preferably towards the free end point. Especially advantageously, for each cross section of the tapering region there is at least one central dilation in which the cross section is at least substantially identical to any other cross section of the tapering region. Preferably the tapering region is embodied cone-shaped or pyramid-shaped. Particularly preferably the tapering region is produced by chemical etching and/or mechanical grinding, in particular during a subsequent processing of an extrusion blank or of the cut extrusion blank. It is conceivable that the tapering region features, completely or at least section-wise, a coloring that differs from the respectively remaining bristle end zone. If either the first or the second bristle end zone comprises the tapering region, the bristle end zone with the tapering region is preferably colored white or transparent, and in particular the other bristle end zone is preferably colored black or in a color that differs from white and/or is particularly preferably opaque. Preferentially the tapering region has a minimum diameter that is maximally 50%, advantageously no more than 25%, especially advantageously no more than 10% and preferably maximally 5% of a maximum diameter of the respective bristle end zone. The minimum diameter is herein advantageously measured in the free end point. A "pyramid-shaped object" is herein in particular to mean an object with a polygonal base area and side surfaces adjoining the base area and meeting in a shared point. By "at least substantially identical cross sections" are herein in particular cross sections to be understood the minimum differential area of which is realized by laying one of the cross sections over the other one and has an area content that is maximally 20%, advantageously no more than 10%, especially advantageously no more than 5% of an area content of the larger one of the two cross sections. This in particular allows reaching small structures like, for example, seams, interstices, corners, edges and similar, when cleaning. Moreover structured surfaces, e.g. of a tooth, and/or interdental spaces and/or hollows are easily reachable as a result of this.

In the following table, for different lengths of a tapering region, possible measurements of a section of a respective bristle end zone are exemplarily given as a percentage of the nominal diameter/maximum diameter:

| Percentage of nominal diameter [tolerance +/− 5% respectively] | | Length of tapering region [mm] | | | |
|---|---|---|---|---|---|
| | | 10 | 20 | 25 | 35 |
| Distance from the free end point [mm] | 0 | 0.00% | 0.00% | 0.00% | 0.00% |
| | 1 | 10.00% | 5.00% | 4.00% | 2.86% |
| | 2 | 20.00% | 10.00% | 8.00% | 5.71% |
| | 3 | 30.00% | 15.00% | 12.00% | 8.57% |
| | 4 | 40.00% | 20.00% | 16.00% | 11.43% |
| | 5 | 50.00% | 25.00% | 20.00% | 14.29% |

-continued

| Percentage of nominal diameter [tolerance +/− 5% respectively] | Length of tapering region [mm] | | | |
|---|---|---|---|---|
| | 10 | 20 | 25 | 35 |
| 6 | 60.00% | 30.00% | 24.00% | 17.14% |
| 7 | 70.00% | 35.00% | 28.00% | 20.00% |
| 8 | 80.00% | 40.00% | 32.00% | 22.86% |
| 9 | 90.00% | 45.00% | 36.00% | 25.71% |
| 10 | 100.00% | 50.00% | 40.00% | 28.57% |
| 11 | 100.00% | 55.00% | 44.00% | 31.43% |
| 12 | 100.00% | 60.00% | 48.00% | 34.29% |
| 13 | 100.00% | 65.00% | 52.00% | 37.14% |
| 14 | 100.00% | 70.00% | 56.00% | 40.00% |
| 15 | 100.00% | 75.00% | 60.00% | 42.86% |
| 16 | 100.00% | 80.00% | 64.00% | 45.71% |
| 17 | 100.00% | 85.00% | 68.00% | 48.57% |
| 18 | 100.00% | 90.00% | 72.00% | 51.43% |
| 19 | 100.00% | 95.00% | 76.00% | 54.29% |
| 20 | 100.00% | 100.00% | 80.00% | 57.14% |
| 21 | 100.00% | 100.00% | 84.00% | 60.00% |
| 22 | 100.00% | 100.00% | 88.00% | 62.86% |
| 23 | 100.00% | 100.00% | 92.00% | 65.71% |
| 24 | 100.00% | 100.00% | 96.00% | 68.57% |
| 25 | 100.00% | 100.00% | 100.00% | 71.43% |
| 26 | 100.00% | 100.00% | 100.00% | 74.29% |
| 27 | 100.00% | 100.00% | 100.00% | 77.14% |
| 28 | 100.00% | 100.00% | 100.00% | 80.00% |
| 29 | 100.00% | 100.00% | 100.00% | 82.86% |
| 30 | 100.00% | 100.00% | 100.00% | 85.71% |
| 31 | 100.00% | 100.00% | 100.00% | 88.57% |
| 32 | 100.00% | 100.00% | 100.00% | 91.43% |
| 33 | 100.00% | 100.00% | 100.00% | 94.29% |
| 34 | 100.00% | 100.00% | 100.00% | 97.14% |
| 35 | 100.00% | 100.00% | 100.00% | 100.00% |

Other geometries of the tapering region are also conceivable, as is shown above.

In an especially advantageous implementation of the invention it is proposed that the tapering region extends over at least 2%, advantageously over at least 5%, especially advantageously over at least 10%, preferably over at least 15% and particularly preferably over at least 25% of a length of the corresponding bristle end zone. In particular, the tapering region has a length that is between 2 mm and 100 mm, advantageously between 3 mm and 50 mm, particularly preferably between 3 mm and 15 mm or between 20 mm and 25 mm or between 35 mm and 45 mm. In this way in particular advantageous characteristics regarding a cleaning of small and deep structures are achievable. Moreover, as a result, advantageous flexural characteristics of a bristle are achievable, wherein longer tapering regions result in more flexible—and thus softer—bristle zones. For example, this allows reliably reaching dental interstices, seams, hollows, unevennesses and the like in cleaning.

In a further implementation of the invention it is proposed that at least one of the bristle end zones has a cross section with at least one concave region. The cross section may be embodied, for example, star-shaped or sinuate. Advantageously the cross section is embodied having a central symmetry with respect to a geometric center of the cross section. In particular, it is conceivable that the respective bristle end zone comprises at least one lamella extending along the main extension direction of the bristle end zone. As a result of this, in particular in case of wet cleaning a large water volume may be taken in by a bristle surface, in particular without a swelling of the bristle, advantageously without the water being absorbed in the bristle. This furthermore advantageously allows providing a large surface for taking up dirt. This implementation additionally allows realizing a plurality of cleaning edges on the bristle in a longitudinal direction. The bristles which are implemented in this way preferably comprise 1-10 cleaning edges, particularly preferably 1-5 cleaning edges.

Further possible shapes of cross sections of bristles are polygonal having n edges (like rectangular, square, triangular, diamond-shaped), oval, egg-shaped, half-moon-shaped, etc., in each case with outward or inward corners.

Advantageously at least one of the bristle end zones is implemented at least partly, in particular at least to a large extent, of a synthetic material. Preferably the synthetic material comprises a respectively in particular thermoplastic polyurethane elastomer (TPE-U) and/or a thermoplastic styrene elastomer (TPE-S) like, for example, thermoplastic styrene ethylene butylene styrene copolymer (SEBS) or thermoplastic styrene butadiene styrene copolymer (SBS) and/or a thermoplastic polyamide elastomer (TPE-A) and/or a thermoplastic polyolefin elastomer (TPE-O) and/or a thermoplastic polyester elastomer (TPE-E) and/or a polyethylene (PE) and/or a polyurethane (PU) and/or Elastollan and/or Desmopan and/or a polyamide elastomer like, for example, Grilflex ELG 5930 and/or a polyester elastomer like, for example, Riteflex 672 RFNat or Riteflex RKX 193 or Hytrel 7248 and/or a polyamide and/or a polyester and/or a biosynthetic material, which is in particular made of a renewable raw material. "Elastollan", "Desmopan", "Grilflex" and "Hytrel" are registered trademarks. It is however also conceivable that at least one of the bristle end zones is at least partly made of wire. If the bristle end zone is produced in an injection-molding procedure, the synthetic material advantageously has a Shore D hardness between 0 and 200, especially advantageously between 10 and 100 and preferably between 30 and 80. In this way, in particular by a production via injection-molding, advantageously low production costs are achievable. This furthermore allows achieving an advantageously reduced susceptibility regarding wetness and/or humidity and/or cleaning agents. It is moreover possible to render a household brush or hygiene brush device available that may be washed out and/or cleaned easily.

For extruded bristles, preferentially polyamide (PA) or polyester, like pure polybutylene terephthalate (PBT), or a mixture of polyethylene terephthalate (PET) and polyester (PBT) are used. Furthermore, for example polypropylene (PP), polyethyleneterephtalate (PET), in particular embodied as Polymex or polycyclohexylene dimethylene terephthalate (PCT-A) are utilized. "Polymex" is a registered trademark.

Especially advantageously the first bristle end zone and the second bristle end zone are implemented at least partly, in particular at least to a large extent, of differing materials. For example, the first bristle end zone may comprise a harder or a softer material than the second bristle end zone. In particular, the materials of the first bristle end zone and the second bristle end zone may differ regarding a rigidity and/or a hydrophily and/or a hydrophoby and/or a lipophily and/or an abrasion resistance and/or a color and/or an electro-static chargeability and/or in their friction coefficients and/or in their geometric shapes and/or in their cross sections. For example, the first bristle end zone and the second bristle end zone may be produced in a co-extrusion procedure. In this way a high level of flexibility is advantageously achievable as regards an application-specific implementation.

In a further implementation of the invention it is proposed that a maximum diameter of the first bristle end zone differs from a maximum diameter of the second bristle end zone, in particular by at least 10% or by at least 20% or by at least 30% or by at least 50% or by at least 70%. In this way different functionalities of a common brush region are advantageously achievable.

In an alternative implementation of the invention it is proposed that the first bristle end zone and the second bristle end zone are connected to one another at least section-wise, in particular integrally, along a main extension direction of the first bristle end zone. Preferentially the first bristle end zone and the second bristle end zone are connected to one another integrally, in particular at least over a large portion of a length of the first bristle end zone. Particularly preferably a main extension direction of the first bristle end zone extends at least substantially parallel to a main extension direction of the second bristle end zone. Advantageously the first bristle end zone encompasses the second bristle end zone at least partially. By a first object "at least partially encompassing" a second object is in particular to be understood that there is at least one projection direction for which at least 80%, advantageously at least 90% and particularly advantageously at least 95% of the points of the projection of the second object are located within a smallest convex polygon encompassing the projection of the first object. In particular, the first bristle end zone and the second bristle end zone together implement a common bristle region, advantageously a bristle, wherein in particular the second bristle end zone embodies a core and the first bristle end zone embodies a shell of the bristle region. Advantageously the second bristle end zone is, at least section-wise, embodied at least substantially in a cylindrical shape. Especially advantageously the second bristle end zone is, at least section-wise, embodied at least substantially in a hollow-cylinder shape, wherein in particular an outer radius of the first bristle end zone is, at least section-wise, at least substantially equivalent to an inner radius of the second bristle end zone. Preferably the first bristle end zone and the second bristle end zone have differing abrasion resistance values, as a result of which in particular an effect of self-sharpening effect with wear is achievable. By "at least substantially" is in particular to be understood, in this context, that a deviation from a set value is equivalent to in particular less than 15%, preferably less than 10% and particularly preferably less than 5% of the set value. "Integrally" is in particular to mean at least connected by substance-to-substance bond, e.g. by a welding process, a gluing process, a co-extrusion, an injection-molding process and/or another process that is deemed expedient by someone skilled in the art, and/or advantageously formed in one piece like, for example, by manufacturing from one cast and/or by manufacturing in a one-component or multi-component injection-molding process, and advantageously from a single blank. By an "at least substantially cylinder-shaped/hollow-cylinder-shaped object" is herein in particular an object to be understood for which a differential volume of the object and a smallest cylinder/hollow cylinder enclosing the object is maximally 30%, advantageously no more than 20%, particularly advantageously maximally 10% and preferably no more than 5% of a volume of the cylinder/hollow cylinder. It is thus advantageously possible to provide a bristle structure with precisely adjustable mechanical and/or geometrical characteristics. Moreover this advantageously allows achieving a high abrasion resistance and/or improved cleaning characteristics.

In a preferred implementation of the invention it is proposed that a length of the first bristle end zone differs from a length of the second bristle end zone. If either the first bristle end zone or the second bristle end zone comprises a tapering cross section, advantageously the bristle end zone comprising the tapering cross section is embodied longer. For example, a difference in length between a length of the first bristle end zone and a length of the second bristle end zone may be at least substantially equivalent to a length of the tapering region; the difference in length may however as well be smaller than the length of the tapering region. Advantageously the difference in length is at least 2%, especially advantageously at least 5%, preferentially at least 10%, preferably at least 15% and particularly preferably at least 25% of a length of the longer one of the bristle end zones. In particular, the difference in length is at least 1 mm, advantageously at least 5 mm, especially advantageously at least 10 mm, preferentially at least 15 mm and particularly preferably at least 30 mm, for example between 5 mm and 15 mm and preferably between 7 mm and 9 mm. Preferentially the longer one of the bristle end zones has a lower flexural rigidity than the shorter one of the two bristle end zones. In this way in particular advantageous cleaning characteristics are achievable for small and/or deep structures, e.g. for seams or for dental interstices. Furthermore, this advantageously allows cleaning in two pressure grades, wherein in a first pressure grade in particular deep and/or small and/or hard-to-access structures may be cleaned by means of the at least one longer bristle end zone, and/or in a second pressure grade in particular planar structures may be cleaned, additionally and/or mostly, by means of the at least one shorter bristle end zone. Moreover an entire bending and/or damaging of a longer bristle end zone is advantageously avoidable.

The first pressure grade is advantageously used in case of a load on the household brush or hygiene brush device, e.g. a dishwashing brush, a washing-up brush, a toilet brush, a scrubber, a broom or a hand broom, of 0 kg to 0.8 kg, preferably 0 kg to 0.4 kg. If the household brush or hygiene brush device is a face brush or an oral-hygiene brush, e.g. a toothbrush, a tongue brush, an interdental cleaner or the like, the first pressure grade is advantageously applied in case of a load of 0 kg to 0.6 kg, preferably 0 kg to 0.3 kg. The second pressure grade is in particular applied if a weight/a load is greater than a weight/load for the first pressure grade. The load set for the first pressure grade may in particular depend on a variety of factors like, for example, a diameter and/or a material and/or a geometry and/or a difference in length of the bristle end zones and/or an arrangement and/or a number and/or a density and/or a composition of bristle end zones and/or of bristles and/or of bristle bundles.

Advantageously at least 70%, particularly advantageously at least 80% and preferentially at least 90% of the bristle end zones of a pressure grade have a length that is, in a range of +/−5 mm, preferably +/−3 mm and particularly preferably +/−2 mm, equivalent to an average length of the bristle end zones of the pressure grade.

In a particularly preferred implementation of the invention it is proposed that the household brush or hygiene brush device comprises at least one third bristle end zone, which is implemented differently from the first bristle end zone and the second bristle end zone. In particular, the third bristle end zone differs from the first bristle end zone and/or from the second bristle end zone regarding one or several of the characteristics by which the first bristle end zone may differ from the second bristle end zone. In particular, it is conceivable that the third bristle end zone at least partly encompasses the first bristle end zone and/or the second bristle end zone. Preferentially the third bristle end zone has a length that is between a length of the first bristle end zone and a length of the second bristle end zone, or is less than these two lengths. It is further conceivable that the household brush or hygiene brush device comprises further bristle end zones, which are respectively implemented differently. In this way a highly multi-fold applicability is advantageously achievable. Moreover, as a result of this bristle characteristics may advantageously be selected from a large field of parameters and may be adapted to an application.

It is also proposed that the household brush or hygiene brush device comprises at least one bristle with the first bristle end zone and with the second bristle end zone. Advantageously the first bristle end zone and the second bristle end zone embody the bristle. Particularly advantageously the first bristle end zone and the second bristle end zone are connected integrally. In particular, a length of the bristle is at least substantially equivalent to a sum of the lengths of the first bristle end zone and the second bristle end zone. It is however also conceivable, in particular if the first bristle end zone at least partly encompasses the second bristle end zone, that a length of the bristle is at least substantially equivalent to a length of the longer one of the two bristle end zones. Advantageously the bristle is anchored and/or articulated in a connection zone between the first bristle end zone and the second bristle end zone. The anchoring/articulation is preferably effected in a region with a constant cross section. In particular, in the anchoring region preferably no tapering of the bristle cross section is provided. It is however also conceivable that the bristle is anchored and/or articulated in an end of the bristle. The bristle may furthermore be glued to the brush head or anchored to the brush head by partial melting several ends of the bristle or injection-molded to the brush head. The partially melted bristle ends may be anchored via injection-molding of hard components and/or soft components. Preferentially a bristle fixation zone of the first bristle end zone and a bristle fixation zone of the second bristle end zone implement the connection zone. Especially advantageously the bristle has, in a mounted state, at least one bend or curve, in particular in the connection zone, wherein in particular the first bristle end zone and the second bristle end zone include an angle of less than 5°, advantageously less than 3° and especially advantageously less than 1°. In this way low production costs and/or simple manufacturing are/is advantageously achievable.

Advantageously the household brush or hygiene brush device comprises at least one bristle bundle comprising the bristle. Particularly advantageously the bristle bundle comprises a plurality of at least substantially identical bristles. It is conceivable that the bristle bundle comprises only bristles with a first bristle end zone and with a second bristle end zone. Preferably the bristles of the bristle bundle each have a bend or a curve, in particular respectively in a connection zone between the first bristle end zone and the second bristle end zone of the respective bristle. Especially preferentially a length of the bristle bundle is at least substantially equivalent to a length of the longest bristle end zone. Advantageously the bristle bundle has an at least substantially circular, elliptic or polygonal cross section, in particular perpendicularly to a main extension direction of the bristle bundle. Especially advantageously the bristle end zones of the bristle bundle have main extension directions extending at least substantially in parallel to one another and/or at least substantially in parallel to the main extension direction of the bristle bundle. In particular, the bristle bundle has a diameter that is between 1 mm and 20 mm, advantageously between 2 mm and 10 mm and particularly preferably between 3 mm and 5 mm.

The diameter of the bristle bundle is understood as the diameter in the point of exit from the brush body and is substantially equivalent to the diameter of the bundle accommodation. The diameter that is measured on a side facing away from the brush body may have another measurement value as the bristles may assume a slightly conical shape, for example due to a shape of the bundle accommodation or for general reasons. The bundle accommodation may herein have a conical shape, as described, i.e. the side walls of the bundle accommodation may be inclined with respect to the longitudinal axis of the bundle accommodation by, for example, between 2° and 25°, preferably between 5° and 15°. If the household brush device is, for example, part of a dishwashing brush or of a washing-up brush, the bristle bundle advantageously has a diameter that is between 2 mm and 8 mm, especially advantageously between 2 mm and 5 mm, and preferably 3 mm. If the household brush device is, for example, part of a toilet brush, the bristle bundle advantageously has a diameter that is between 2 mm and 8 mm, especially advantageously between 2.5 mm and 5.5 mm, and preferably 3.7 mm. If the household brush device is, for example, part of a scrubber, the bristle bundle advantageously has a diameter that is between 2 mm and 8 mm, especially advantageously between 3.5 mm and 6.5 mm, and preferably 5 mm. If the household brush device is, for example, part of a broom or of a hand broom, the bristle bundle advantageously has a diameter that is between 2 mm and 8 mm, especially advantageously between 2.5 mm and 5.5 mm, and preferably 3.7 mm. If the household brush or hygiene brush device is, for example, part of a face brush, or of an oral-hygiene brush like, for example, a toothbrush, an interdental cleaner, a tongue brush or similar, the bristle bundle advantageously has a diameter that is between 1 mm and 3 mm, especially advantageously between 1.5 mm and 2.5 mm. By "at least substantially identical" is herein in particular to be understood identical except for manufacturing tolerances and/or in the range of production-technological possibilities. This advantageously allows making a bristle bundle with advantageous cleaning characteristics available.

In a preferred implementation of the invention it is proposed that the bristle bundle comprises at least one further bristle, which is implemented differently than the bristle. For example, the further bristle comprises at least one third bristle end zone, in particular precisely two third bristle end zones. The third bristle end zones are preferentially embodied at least substantially cylinder-shaped and are in particular produced in an extrusion procedure with subsequent cutting-to-size and, for household brushes, advantageously without subsequent mechanical machining like, for example, rounding off. On the other hand, rounding-off is desired for hygiene brush devices, in particular oral-hygiene brush devices like, for example, toothbrushes and face brushes. It is however also conceivable that the further bristle comprises further bristle end zones, which are respectively embodied in different ways. Advantageously the bristle bundle is embodied by a plurality of bristles and a plurality of further bristles. Advantageously the bristle bundle comprises between 20% and 80%, particularly advantageously between 30% and 70%, preferably between 40% and 60% and particularly preferably 50% further bristles. In this way in particular a high level of multifold applicability is achievable.

Beyond this it is proposed that the bristle bundle comprises a first number of first bristles, which are in particular embodied at least substantially identically to the bristle, and comprises a second number of second bristles, which are embodied differing from the first bristles and are in particular embodied at least substantially identically to the further bristle. The first number may herein be different from or identical to the second number. In particular, the bristle bundle may thus comprise up to four different bristle end zones in a pre-defined and/or selectable number ratio.

In a particularly preferred implementation of the invention it is proposed that the household brush or hygiene brush device comprises at least one bristle anchor, which is in particular at least partially embodied of a metal and which fixates the bristle bundle off-center relative to a longitudinal direction of the bristle, in particular relative to a longitudinal direction of the bristle in a pre-mounted, advantageously unbent state. In particular, a distance of an anchor position on the bristle from a center of the bristleas seen with respect to the longitudinal direction of the bristle, corresponds to half a difference in length between the length of the first bristle end zone and the length of the second bristle end zone. Advantageously the bristle anchor fixates the bristle in the connection zone of the first bristle end zone and the second bristle end zone. If the bristle bundle comprises the further bristle, the bristle anchor advantageously fixates the further bristle centrally relative to a longitudinal direction of the further bristle. It is however also conceivable that the bristle anchor fixates the further bristle off-center with respect to the longitudinal direction of the further bristle, in particular in a distance from a center of the further bristle that is different than the case of the bristle. It is furthermore also conceivable that the bristle bundle is fixatednot by a bristle anchor but in particular by a loop, i.e. a bent piece of wire. It is moreover conceivable that the first bristle end zone and the second bristle end zone each implement a bristle and are in particular respectively fixated, in particular glued, in a bristle fixation zone via partially melting a plurality of bristle ends, or that the bristle ends are injection-molded by hard components or soft components. The partially melted bristle ends may also be anchored on a separate carrier body. The separate carrier body (embodied, for example, as a plate) may then be fixated to the brush head by a suitable procedure (e.g. via ultrasonic welding, gluing, injection-molding with hard and/or soft-component). In this case the household brush or hygiene brush device does not comprise a bristle anchor. In this way in particular simple and/or quick production is achievable.

An example for an anchorless bristle anchoring procedure is the Anchor Free Tufting (AFT) procedure of Boucherie N.V. of Izegem, Belgium. In the AFT procedure (Anchor Free Tufting) the customary cylindrical or tapered bristles, respectively the bristle bundles, are fixated to a carrier body without using an anchor. The cut-to-size bristles are herein profiled bundle-wise and are guided, with their respective end that is opposite the free usage end, through passages in a bristle carrier in such a way that an end region of the bristle bundles protrudes beyond the underside, respectively the rear side of the bristle carrier. On this end region of the bristles, which protrudes beyond the rear side of the carrier body, the bristles are fixated by partial melting, gluing or welding. The carrier body is then anchored, together with the bristles fixated therein, in a recess of the brush head of the brush, for example via ultrasonic welding. The recess in the brush head is herein specifically adapted to the geometry of the carrier body. Besides the customary bristles the carrier body, or the head part of the brush, may also comprise soft-elastic massaging and cleaning elements.

Another example for an anchorless punching process is the PTt procedure of Boucherie N.V., Izegem, Belgium. In the PTt procedure the customary cylindrical or tapered bristles, respectively the bristle bundles, are fixated to the carrier body without using an anchor. The cut-to-size bristles are herein profiled bundle-wise and are connected on their respective end that is opposite the free usage end via melting. These bundles are then with their partially melted ends inserted in recesses, in this case in blind holes, of a bristle carrier and are in the process fixated by heat and pressure. Besides the customary bristles, the carrier body and/or the head part of the brush may comprise soft-elastic massaging elements and cleaning elements.

For a processing of the bristles in the procedure, they must be conveyed to a respective bristling machine. The bristles are for this purpose gathered to form so-called bristle pucks. A bristle puck comprises a plurality of closely-packed bristles, which are thus directly adjacent to one another and are hence packed most tightly in a minimum of space. The bristle pucks are preferentially configured in such a way that on one "flat" side there are only cylindrical bristle ends and the variability regarding an end shape and length is realized on the other "flat" side. It is thus possible to combine different kinds of bristles in a bristle puck, i.e. a random mix of bristles having different characteristics may be introduced in a bristle puck. The variability may herein concern, for example, the following characteristics: bristle length, shaping of a bristle end, a bristle cross section, and a bristle coloring. The bristle pucks are conveyed to the bristling machine and are conveyed, together with other bristle pucks, to a separating unit in a so-called feed channel. In separating, bristle bundles are respectively separated off, and are either re-combined at a later stage or are directly introduced into a bundle accommodation. Due to the random mixing of the bristles in the bristle puck, the individual so-called pucks are not uniformly provided with the same kind of bristles but contain a random number of bristles with different characteristics in combination.

It is further proposed that the brush application region comprises at least the bristle bundle and at least one further bristle bundle, which is embodied differently than the bristle bundle. It is, for example, conceivable that the further bristle bundle comprises only further bristles. It is however also conceivable that the further bristle bundle comprises a composition of bristles and further bristles, and possibly other bristles, that differs from a composition of the bristle bundle, i.e. has differing properties. In particular, the further bristle bundle has, relative to the bristle bundle, a differing diameter and/or a differing length and/or a differing bristle coloring and/or a differing bristle cross section and/or a different shape of the bundle accommodation and/or a differing anchoring and/or a differing bristle density. Advantageously the brush application region comprises a plurality of bristle bundles and a plurality of further bristle bundles. Particularly advantageously the brush application region comprises at least one first region with a plurality of bristle bundles and at least one second region with a plurality of further bristle bundles. It is conceivable that the bristle bundles and/or the further bristle bundles have main extension directions extending at least substantially parallel to one another, in particular in the case of a household brush or hygiene brush device of a scrubber or of a broom. It is also conceivable that the brush application region comprises a plurality of regions of bristle bundles and/or further bristle bundles. Bristle bundles and/or further bristle bundles arranged therein respectively have main extension directions extending at least substantially in parallel to one another. Advantageously the first region abuts on the second region. Especially advantageously the first region encompasses the second region at least partially. Preferably the first region forms a crown around the second region, or the second region forms a crown around the first region. In this way in particular advantageous characteristics regarding a multifold applicability are achievable. This further allows providing an advantageous geometry regarding a cleaning efficiency.

Moreover it is proposed that the brush application region comprises at least one bristle accommodation region with a plurality of bristle bundles and/or further bristle bundles. Particularly advantageously the bristle accommodation region comprises a plurality of bundle accommodations, in which, at least in a mounted state, respectively one bristle bundle and/or further bristle bundle is anchored. Advantageously the household brush or hygiene brush device comprises at least one bundle accommodation, in which a bristle anchor is fixated, in particular via anchor punching or loop punching. It is conceivable that at least a plurality of the bristle anchors or loops are arranged in parallel to one another in the respective bundle accommodations. It is however also conceivable that at least a plurality of the bristle anchors or loops are arranged at various angles to one another. In this way a pattern defined by the orientations of the bristle anchors may in particular be regular, irregular, symmetrical or asymmetrical. In particular, the bundle accommodations each have a bundle accommodation direction that is at least substantially parallel to a main extension direction of a bristle bundle or of a further bristle bundle anchored in the bristle accommodation. Advantageously the bristle accommodations are implemented as blind holes, which are in particular cylindrical, advantageously cone-shaped towards the closed end and/or flaring in their free end, in particular in the form of a beveling or in the form of a diameter-jump. Especially advantageously the bristle accommodations are produced at least partly by drilling. A production of the bristle accommodations by drilling may be realized in particular with wooden or synthetic brush heads. It is however also conceivable that the bristle accommodations are produced in/during an injection-molding procedure, in particular together with the brush head. The bundle accommodations are preferably arranged in the brush head. Preferentially the bundle accommodations have a cross section that is at least substantially identical to a cross section of an anchored bristle bundle. In particular, it is conceivable that the bristle accommodation region comprises a plurality of differently embodied bundle accommodations. It is conceivable that the bundle accommodations are distributed over the bristle accommodation region regularly, in particular following—at least in partial regions—a pattern, and/or are arranged in longitudinal and/or in horizontal rows and/or in, in particular concentric, circles or ellipses or polygons. It is however also conceivable that the bristle accommodation region comprises at least one region with a plurality of regularly-arranged bundle accommodations, and/or at least one further region with a plurality of irregularly-arranged bundle accommodations.

The cross sections of the bundle accommodations may be implemented circle-shaped or polygonal. In certain bristling procedures there are also bundle accommodations conceivable which are, for example, annulus-shaped, circle-segment-shaped, star-shaped, crescent-shaped, half-moon-shaped, triangular, rectangular, square, oval/elliptic, egg-shaped, generally polygon-shaped, trapezoid-shaped, rhomboid-shaped or rhomb-shaped.

Larger bundles, so-called puck tufts, may also be realized. These are distinct insofar as each is a more planar bundle, taking up a larger area in the bristle region, which means that, while the number of bristle bundles decreases, the total area content of the bristle end zones increases.

In a so-called puck tuft various finishing processes of bristle ends may be realized. Bristle lengths may differ, and differing bristle cross sections, bristle colorings etc. may be combined in a puck tuft.

In an advantageous implementation of the invention it is proposed that the brush application region comprises at least one bristle accommodation region with a plurality of bristle bundles and/or further bristle bundles, whose main extension directions run at different angles to each other. In particular, at least two of the main extension directions of the bristle bundles and/or of the further bristle bundles extend askew to each other or in a plane and at a 180-degree angle relative to one another. It is, for example, conceivable that, depending on a positioning of a bristle bundle relative to a center of the brush application field, a smallest angle between main extension directions of a bristle bundle and/or of a further bristle bundle changes, in particular decreases. Advantageously the brush head implements the bristle accommodation region. Preferably the bristle accommodation region comprises a plurality of bundle accommodations whose bundle accommodation directions extend in different angles to each other. This in particular allows providing a brush application region having an advantageous geometry, which is in particular adapted to an application.

With hygiene brushes, for example, this allows achieving a so-called X-positioning of the bristle bundles (bundles forming an X, in a view). Said X-positioning may be assumed, for example, by entire rows opposite each other (e.g. bundles on straight lines or bundles on circles). It may also be assumed by separate bundles opposite each other. It is for example possible that, in a bristle region of a plug-on brush of a rotating/oscillating electrical tooth brush, the bundles are principally arranged in circles, and the bundles may be inclined tangentially to the circle, for example alternatingly in the one direction and in the other direction. It is also possible to pitch the circles of bristle bundles into one another radially. It is further possible to combine radial and tangential inclinations. With manual toothbrushes, longitudinal or transverse rows may for example be inclined, thus forming an X-pattern.

The bristle bundles are arranged in bundle accommodations. A number of bundle accommodations of the household brush or hygiene brush device is in particular 10 to 250, preferentially 50 to 200. If the household brush device is, for example, part of a dishwashing brush or a washing-up brush, the number of bundle accommodations is 40 to 90, preferably 55 to 75. If the household brush device is, for example, part of a toilet brush, the number of bundle accommodations is 70 to 130, preferably 90 to 110. If the household brush device is, for example, part of a scrubber, the number of bundle accommodations is 110 to 170, preferably 130 to 150. If the household brush device is, for example, part of a broom, the number of bundle accommodations is 160 to 230, preferably 180 to 210. If the household brush device is, for example, part of a hand broom, the number of bundle accommodations is 50 to 110, preferably 65 to 95. If the household brush or hygiene brush device is, for example, part of a face brush, the number of bundle accommodations is 70 to 150, preferably 90 to 130. If the household brush or hygiene brush device is, for example, part of a toothbrush, the number of bundle accommodations is 10 to 70, preferably 20 to 50.

The surface area of the bristle accommodation region, which the bundles are introduced in, is in particular 1,000 $mm^2$ to 10,000 $mm^2$, preferably 2,000 $mm^2$ to 9,500 $mm^2$. If the household brush device is, for example, part of a dishwashing brush or a washing-up brush, the surface area is 1,500 $mm^2$ to 3,000 $mm^2$, preferably 2,000 $mm^2$ to 2,500 $mm^2$. If the household brush device is, for example, part of a toilet brush, the surface area is 4,500 $mm^2$ to 5,500 $mm^2$, preferably 4,700 $mm^2$ to 5,200 $mm^2$. If the household brush device is, for example, part of a scrubber, the surface area is 6,500 $mm^2$ to 8,000 $mm^2$, preferably 6,900 $mm^2$ 7,500 $mm^2$. If the household brush device is, for example, part of a broom, the surface area is 8,500 $mm^2$ to 9,500 $mm^2$, preferably 8,700 $mm^2$ to 9,300 $mm^2$. If the household brush device is, for example, part of a hand broom, the surface area is 2,500 $mm^2$ to 3,500 $mm^2$, preferably 2,700 $mm^2$ to 3,300 $mm^2$. If the household brush or hygiene brush device is, for example, part of a face brush, the surface area is 1,000 $mm^2$ to 4,000 $mm^2$, preferably 1,000 $mm^2$ to 3,000 $mm^2$. If the household brush or hygiene brush device is, for example, part of a toothbrush, the surface area is 100 $mm^2$ to 600 $mm^2$, preferably 150 $mm^2$ to 500 $mm^2$.

The surface area of the bundle accommodation, in particular of a cross section of the bundle accommodation in the exit point from the brush body, is in total in particular from 40 $mm^2$ to 6,000 $mm^2$, preferably 200 $mm^2$ to 4,000 $mm^2$, particularly preferably 500 $mm^2$ to 3,000 $mm^2$. If the household brush device is, for example, part of a dishwashing brush or washing-up brush, the surface area is 300 $mm^2$ to 600 $mm^2$, preferentially 400 $mm^2$ to 500 $mm^2$. If the household brush device is, for example, part of a toilet brush, the surface area is 800 $mm^2$ to 1,300 $mm^2$, preferentially 1,000 $mm^2$ to 1,200 $mm^2$. If the household brush device is, for example, part of a scrubber, the surface area is 2,200 $mm^2$ to 2,800 $mm^2$, preferentially 2,400 $mm^2$ to 2,600 $mm^2$. If the household brush device is, for example, part of a broom, the surface area is 1,800 $mm^2$ to 2,400 $mm^2$, preferentially 2,000 $mm^2$ to 2,200 $mm^2$. If the household brush device is, for example, part of a hand broom, the surface area is 500 $mm^2$ to 1,200 $mm^2$, preferentially 700 $mm^2$ to 1,000 $mm^2$. If the household brush or hygiene brush device is, for example, part of a face brush, the surface area is 100 $mm^2$ to 800 $mm^2$, preferentially 200 $mm^2$ to 400 $mm^2$. If the household brush or hygiene brush device is, for example, part of a toothbrush, the surface area is 40 $mm^2$ to 100 $mm^2$, preferentially 60 $mm^2$ to 90 $mm^2$.

A percentage, respectively the ratio of the surface area of the bundle accommodation, in particular of a cross section of the bundle accommodation in the exit point from the brush body, to a surface area of the bristle accommodation region which the bundles are introduced in, is in total in particular from 10% to 50%, preferably from 15% to 45%. If the household brush device is, for example, part of a dishwashing brush or a washing-up brush, the portion, respectively the ratio is 15% to 30%, preferably 20% to 25%. If the household brush device is, for example, part of a toilet brush, the portion, respectively the ratio is 5% to 30%, preferably 20% to 25%. If the household brush device is, for example, part of a scrubber, the portion, respectively the ratio is 25% to 45%, preferably 32% to 38%. If the household brush device is, for example, part of a broom, the portion, respectively the ratio is 15% to 30%, preferably 20% to 25%. If the household brush device is, for example, part of a hand broom, the portion, respectively the ratio is 20% to 35%, preferably 25% to 30%. If the household brush or hygiene brush device is, for example, part of a face brush, the portion, respectively the ratio is 10% to 35%, preferably 12% to 24%. If the household brush or hygiene brush device is, for example, part of a toothbrush, the portion, respectively the ratio is 10% to 50%, preferably 15% to 30%.

In an especially advantageous implementation of the invention it is proposed that the brush application region comprises at least one bristle accommodation region that is curved in at least one spatial direction and comprises a plurality of bristle bundles and/or further bristle bundles. The bristle accommodation region is, for example, domed along the spatial direction. In particular, the bristle accommodation region has, along a longitudinal direction, a different curvature than along a transverse direction. It is also conceivable that the bristle accommodation region is embodied rotationally symmetrically and/or comprises several rotationally and/or axially symmetrical partial regions. It is furthermore conceivable that the bristle accommodation region comprises a plurality of bundle accommodations, the bundle accommodation directions of which are respectively, in a region of the respective bundle accommodation, at least substantially parallel or are rotated by a constant angle to a surface normal of the bristle accommodation region. Preferentially the bristle bundles and/or the further bristle bundles, in particular respectively with an end facing away from the corresponding bundle accommodation, implement a surface area that is curved in at least one spatial direction. In this way a geometry may be rendered available that is advantageous as regards a cleaning effect. This moreover allows achieving a high level of flexibility regarding an application-specific implementation.

In a preferred implementation of the invention it is proposed that the household brush or hygiene brush device comprises a plurality of bristle bundles and/or further bristle bundles, whose main extension directions include different angles with a surface of the bristle accommodation region. Advantageously the household brush or hygiene brush device comprises a plurality of bundle accommodations, whose bundle accommodation directions include different angles with the surface of the bristle accommodation region. In particular, the household brush or hygiene brush device comprises a plurality of regions. Bristle bundles arranged in said regions respectively include the same angle with the bristle accommodation region. In particular, the smallest included angles are greater than 30°, advantageously greater than 45°, particularly advantageously greater than 60° and preferably greater than 75°. Advantageously the bristle bundles and/or the further bristle bundles implement, in particular respectively with an end facing away the corresponding bundle accommodation, a surface area that differs from all surface areas that are similar and/or congruent to a surface area of the bristle accommodation region. In this way a high level of variability is advantageously achievable as regards a bristle arrangement. This moreover allows a flexible adaption of a brush geometry.

Principally further elements may be introduced in the brush application region, e.g. elements made of a soft component, which are shaped in a fashion differing from bristle-like and/or planar elements. An example for a shape is herein a lamella, which may be incorporated in the bristle region and/or in a periphery of the bristle region. Further possible shapes are knobs, circle-shaped or circle-segment shaped elements, sickle-shaped elements, polygon-shaped elements, etc.

Manufacturing of the tapering of the bristles may be realized, as has been described above, chemically or mechanically. In a brush production process the tapering may be realized in different positions in the production flow. The tapering may principally be realized prior to a fixation of the bristles, in bristle bundles, in the brush head or subsequently to the fixation in the brush head. Preferentially the tapering is produced prior to the fixation of the bristles in the brush head.

In the production process the further bristle ends, in particular the bristle ends which are arranged adjacent to the tapering bristle ends in the bristle region, preferably do not undergo further machining. This means that these bristle ends are not further processed subsequently to the cutting-to-size or cutting. Advantageously they are not rounded off either. Thus principally the entire brush head as such is preferably not further processed either. As a result, due to processing certain bristle end zones may stand up higher than is desired. It may therefore be possible, for optical reasons, that projecting bristle ends are removed manually and/or that the entire brush head is cut mechanically, said cutting only concerning the projecting bristle ends.

In the production process the bristles are advantageously lined up in a channel and then conveyed to the bristle anchoring process (punching). Herein the bristles preferably rest upon a guiding surface with their cylindrical portion while the other end, which may for example be tapered, is free. As a result of this, the bristles may be handled in a process-stable manner as their position is fixed. In case of having them supported on the tapered end, this end would be bent and the orientation would no longer be identical for all bristles. The bristles are advantageously moved along in the channel (towards the punching apparatus) by means of a pusher. The pusher is herein arranged in such a way that it presses onto the cylindrical portion of the bristle. In this way the bristles are held in a stable fashion. Preferably the pusher is accordingly adapted to a respective bristle length, respectively a length of the tapering.

Improved characteristics regarding cleaning efficiency are achievable by a household brush or hygiene brush, advantageously by an oral-hygiene brush, e.g. a tooth brush, an interdental cleaner, a tongue brush, a vegetable brush, a dishwashing brush, a washing-up brush, a bottle brush, a hairbrush, a beard brush, a toilet brush, a wire brush, a nailbrush, a face brush, a bathing brush, a shoe brush, a pipe brush, a scrubber, a broom or a hand broom, with at least one household brush or hygiene brush device according to the invention. The household brush or hygiene brush may in particular be implemented as a manual household brush or hygiene brush. Furthermore, improved characteristics regarding a cleaning efficiency are achievable, for example, with household brush or hygiene brush devices, e.g. for face brushes, bathing brushes, cosmetics brushes (for example for nail polish or mascara or make-up), for cosmetics applicators (brushes for the application of cosmetics products), e.g. a hair color applicator or another type of fluid applicator, for shaving brushes, medical applicators or brushes for cleaning a razor device or a depilating apparatus.

The invention further comprises an electrical household brush or hygiene brush device, in particular an electrical toothbrush or an electrical face brush or the like. In this way a high level of comfort is achievable. It is moreover possible to variably adapt bristle characteristics and/or bristle distributions to different electrical brushes, in particular electrical toothbrushes.

It is further proposed to use a household brush or hygiene brush device according to the invention for bodycare, in particular for oral care, advantageously in the field of oral hygiene, e.g. for cleaning teeth, for prophylaxis, for tongue cleaning, for mouth space care or the like. It is herein advantageously possible to facilitate thorough and/or gentle cleaning and/or care of body parts, in particular of a mouth space, e.g. of teeth. Advantageously bristle characteristics, e.g. a geometry, a material composition or a ratio of numbers of bristles and/or bristle end zones, are variably adaptable to different usages.

The invention also comprises a usage of a household brush or hygiene brush device according to the invention for cleaning, in particular household cleaning, e.g. for floor cleaning, for the cleaning of seams and/or interstices, hollows, heating elements, sanitary items, or the like. Herein advantageous characteristics regarding a thorough and/or comfortably implementable and/or quick cleaning are achievable.

Furthermore the invention comprises a method for cleaning or bodycare, in particular for household cleaning, body cleaning, bodycare, oral care, face care or the like, wherein at least one object, in particular a household item, a portion of a building, a body and/or a body part, is cleaned and/or treated with the household brush or hygiene brush device, in particular with the household brush or hygiene brush.

The invention further comprises a method for a production of the household brush or hygiene brush device, and in particular a method for a production of the household brush or hygiene brush.

The household brush or hygiene brush device according to the invention is herein not to be restricted to the application and implementation described above. In particular, to fulfill a functionality that is described here, the household brush or hygiene brush device according to the invention may comprise a number of individual elements, structural components and units that differs from a number mentioned here. Moreover, regarding the value ranges given in the present disclosure, values located within the limits mentioned shall also be considered to be disclosed and to be applicable according to requirements.

DRAWINGS

Further advantages will become apparent from the following description of the drawings. In the drawings eleven exemplary embodiments of the invention are depicted. The drawings, the description and the claims contain a plurality of features in combination. Someone skilled in the art will purposefully also consider the features individually and will find further expedient combinations.

In the exemplary embodiments described below, there is a plurality of various structural units and/or structural components. For the sake of simplification, analogously implemented structural components and/or structural units, which are given the same reference numerals in the drawings, will be described only once in the following description of the drawings.

Figure 2:
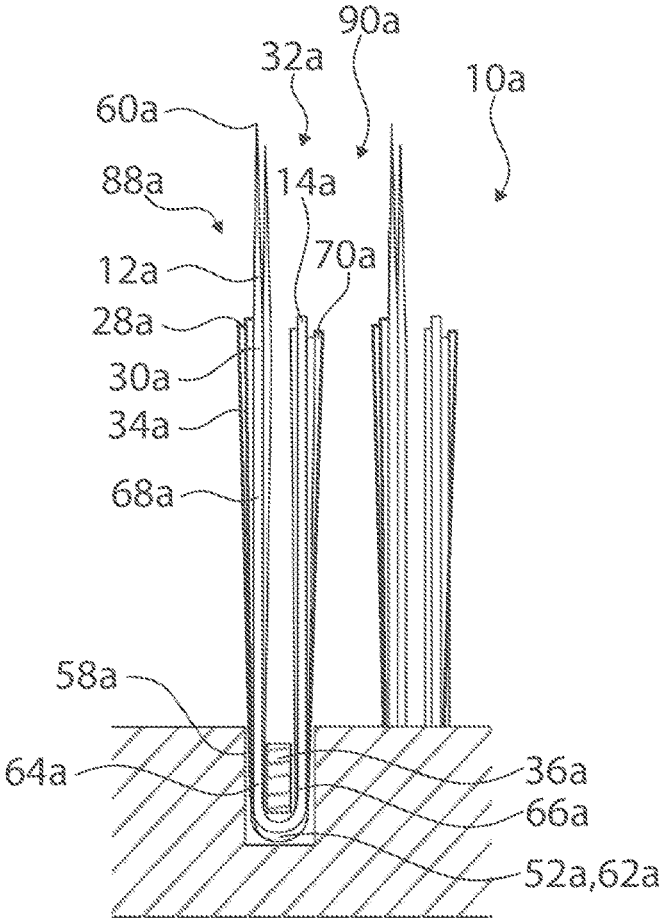
Figure 3:
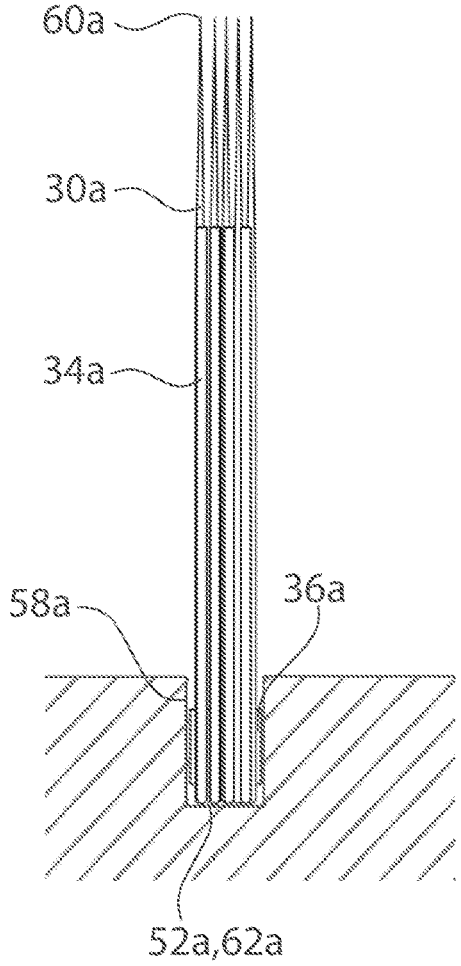
Figure 4:
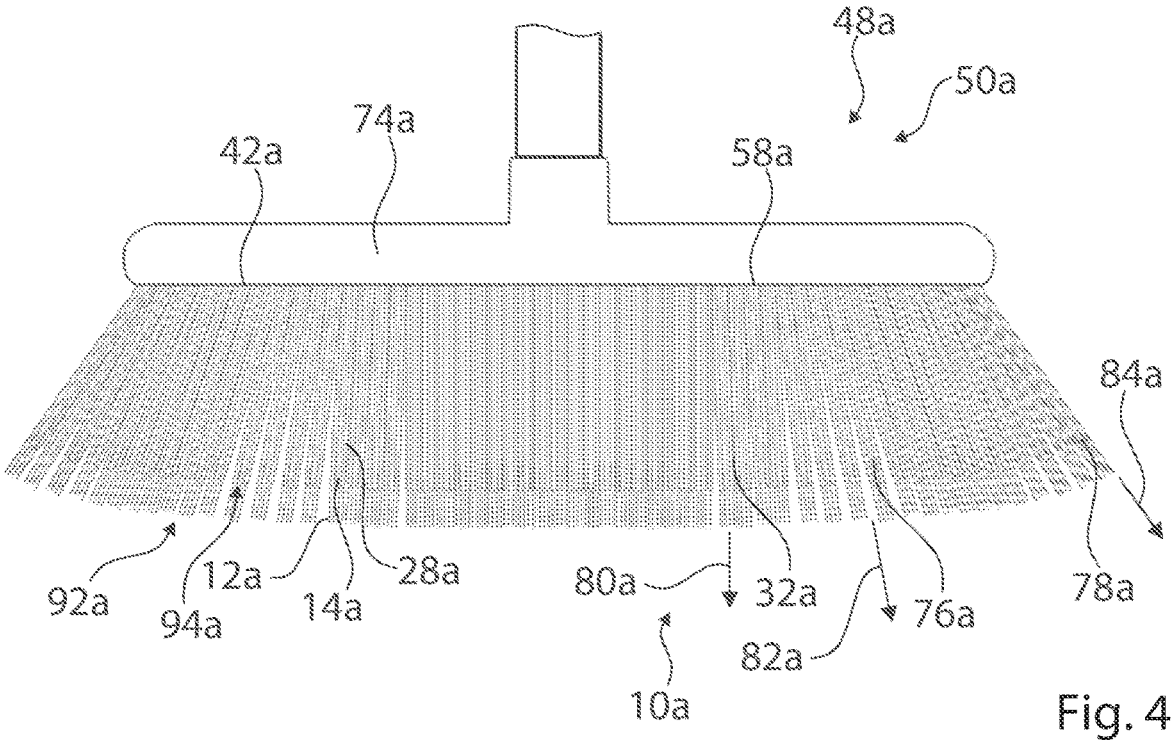
Figure 5:
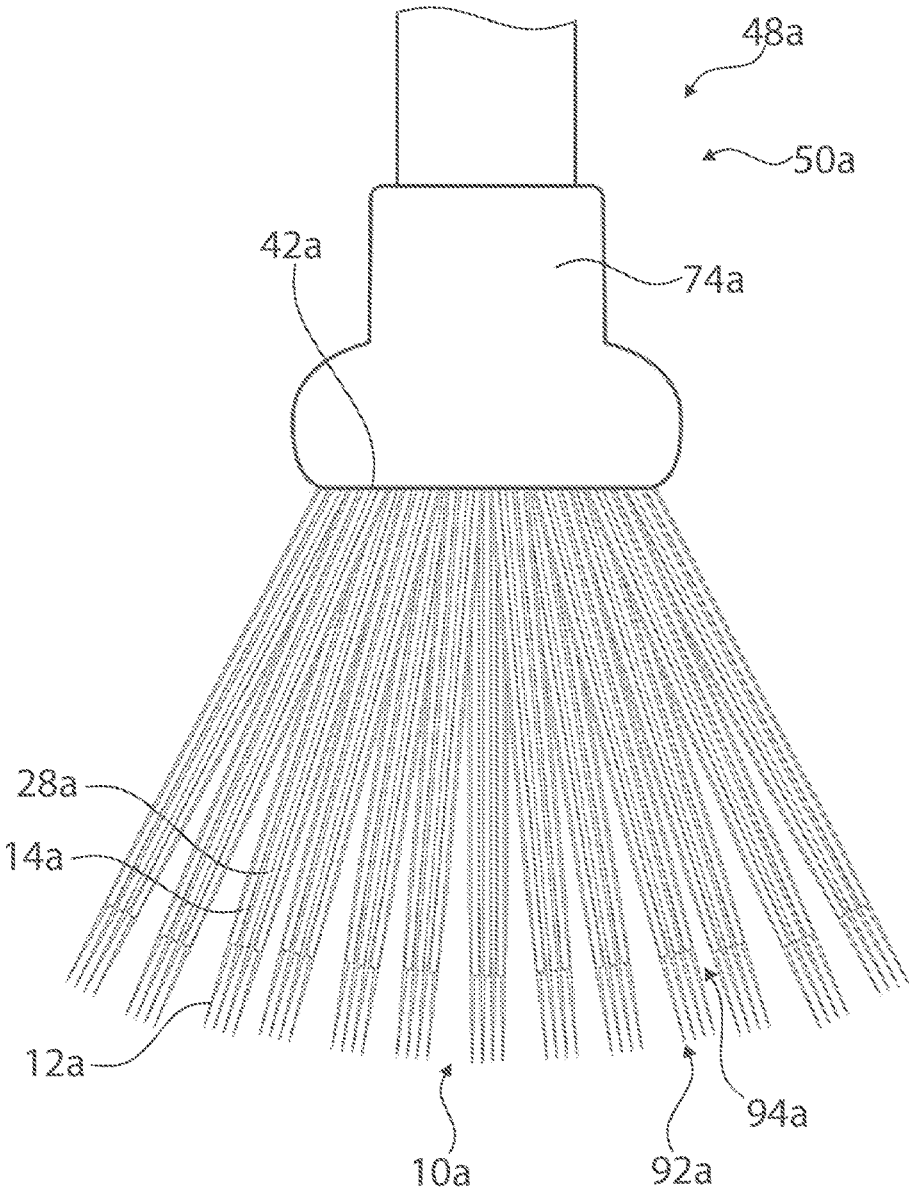
Figure 6:
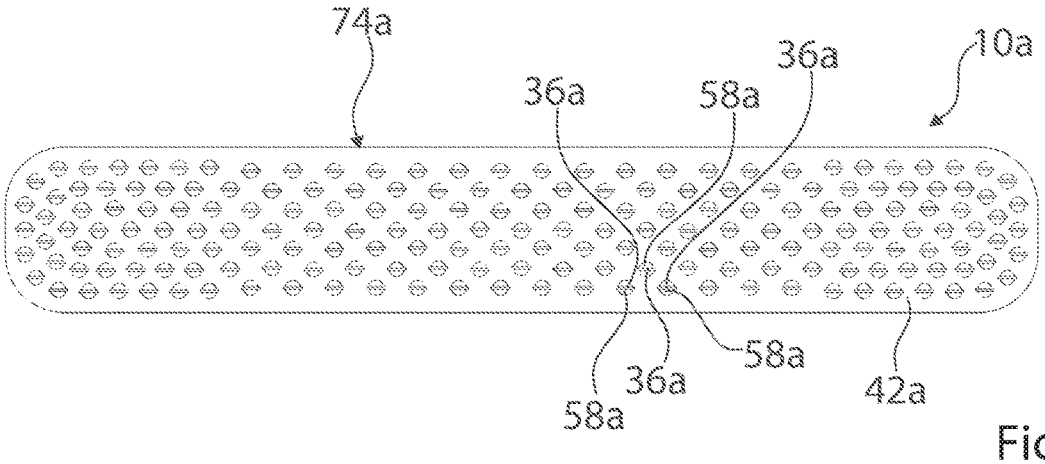
Figure 7:
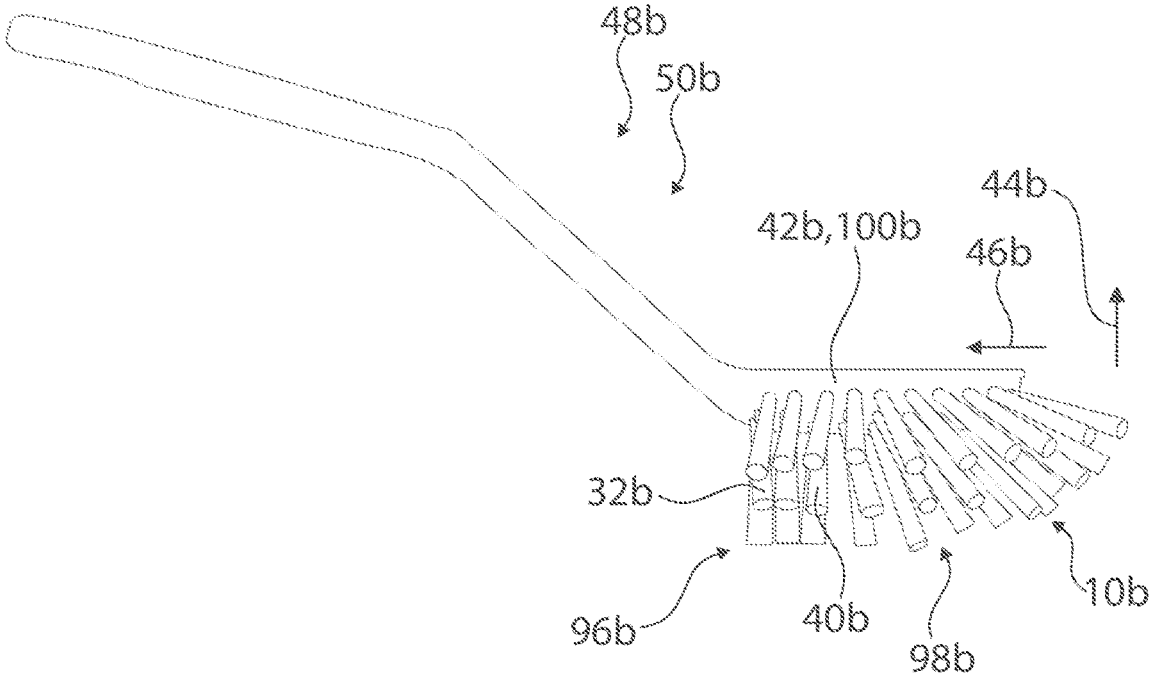
Figure 8:
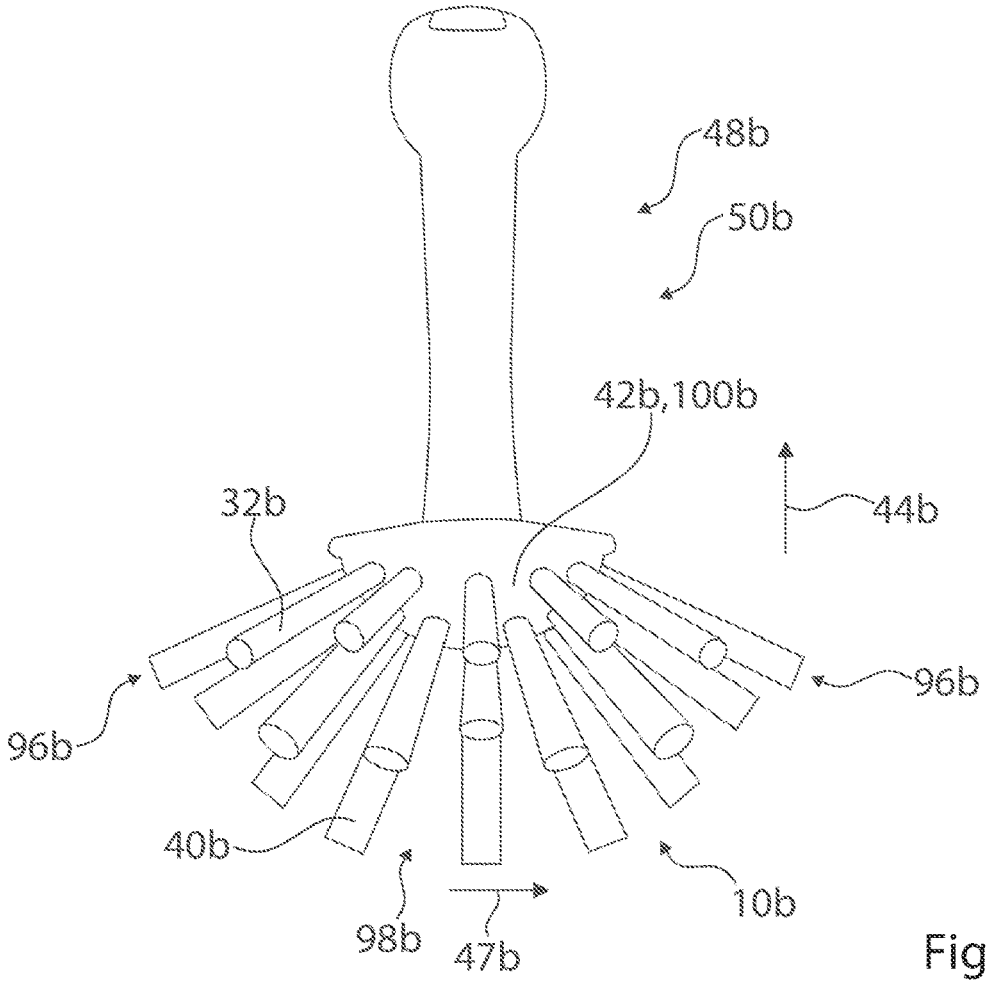
Figure 9:
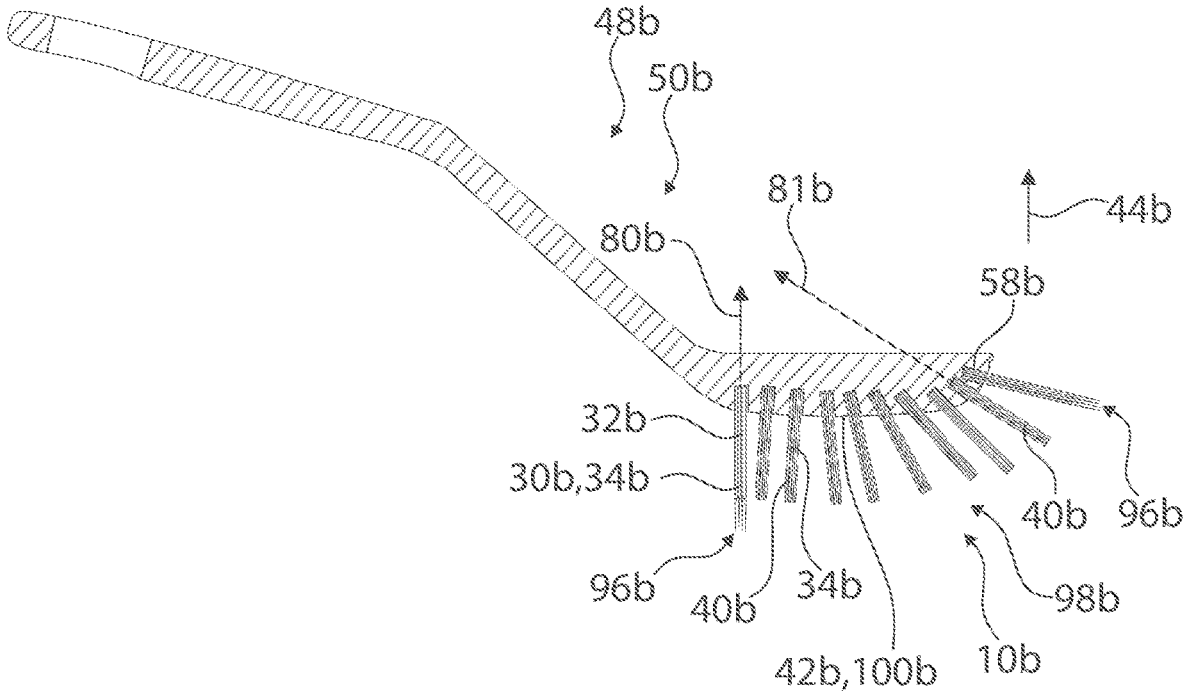
Figure 10:
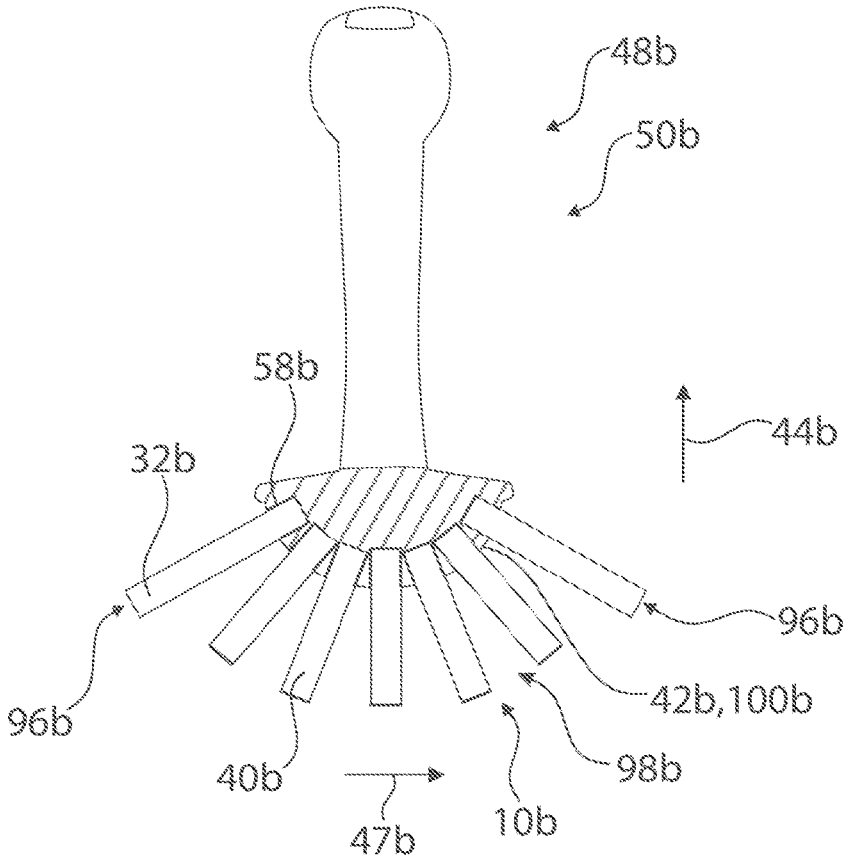
Figure 11:
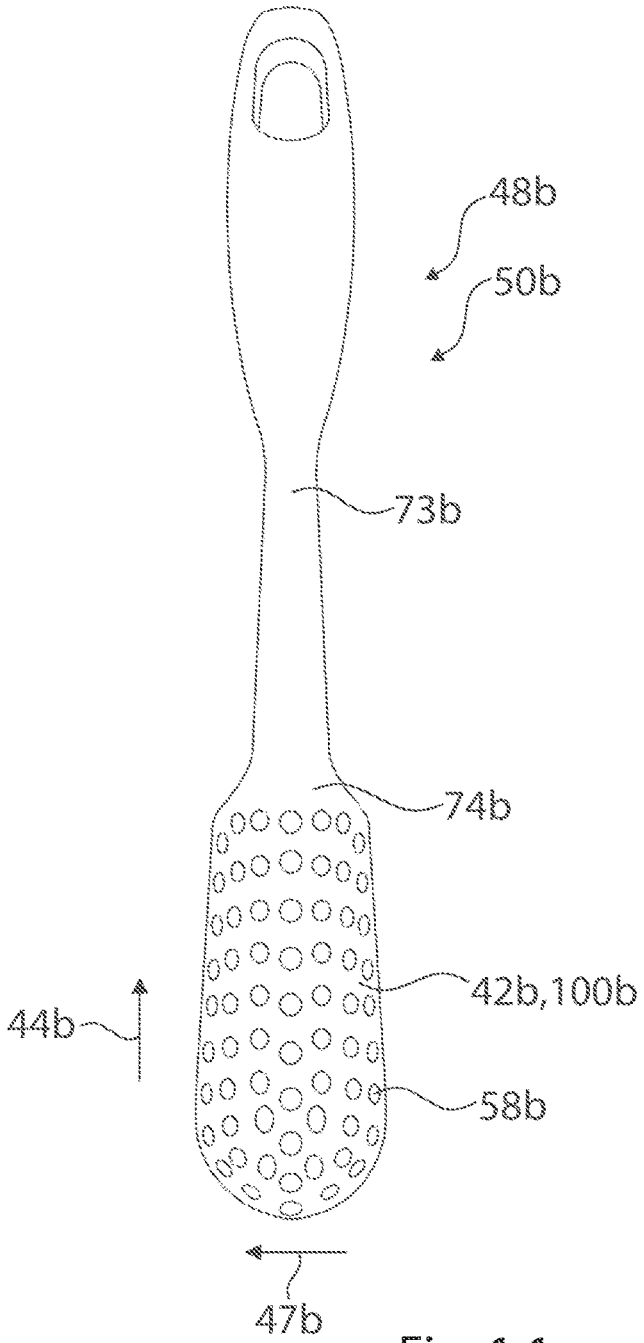
Figure 12:
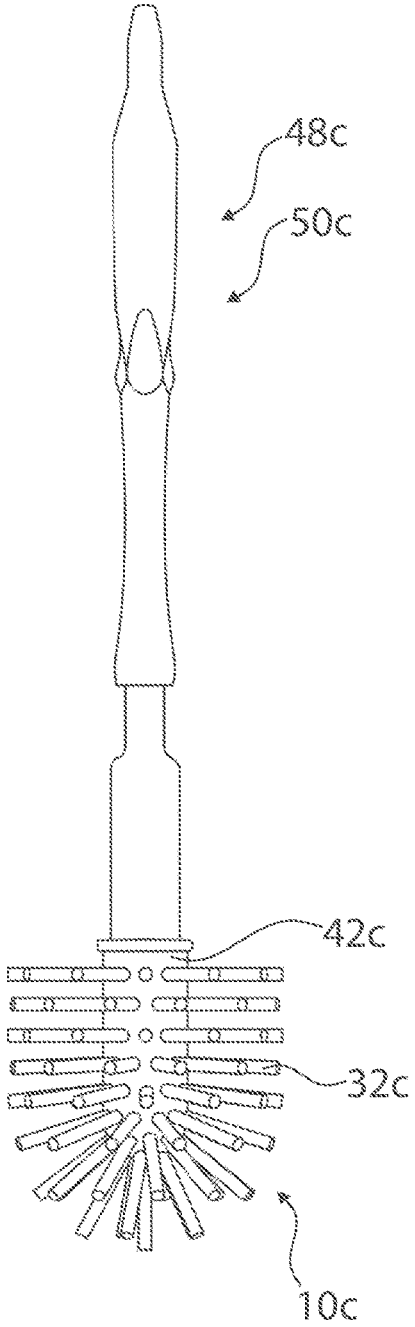
Figure 13:
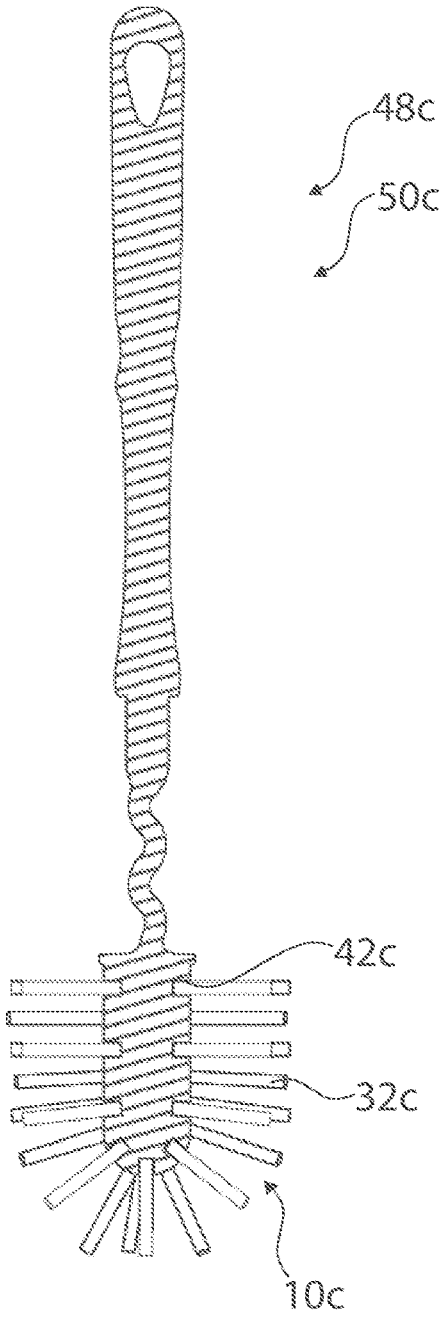
Figure 14:
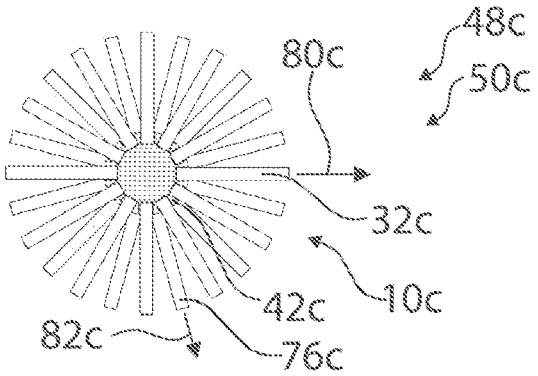
Figure 15:
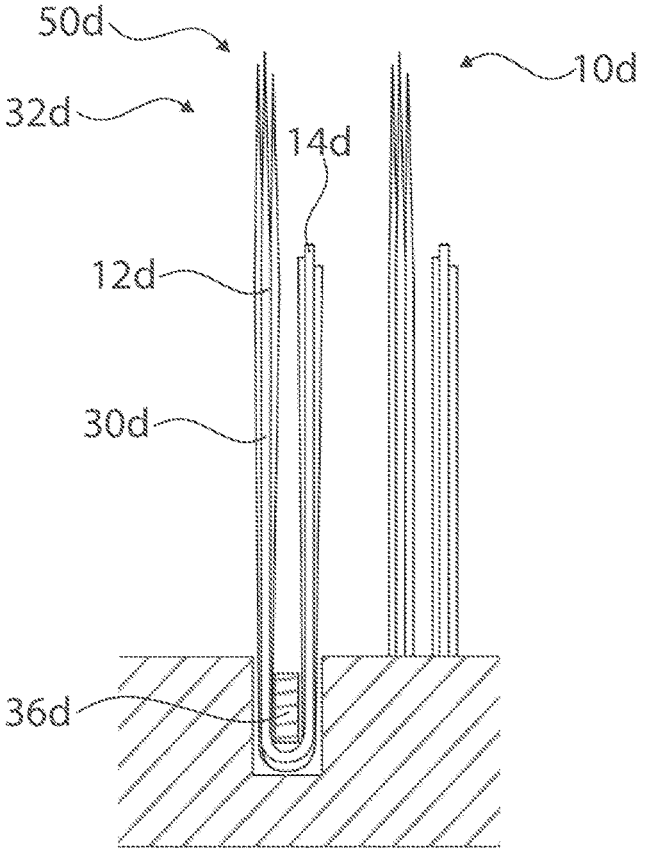
Figure 16:
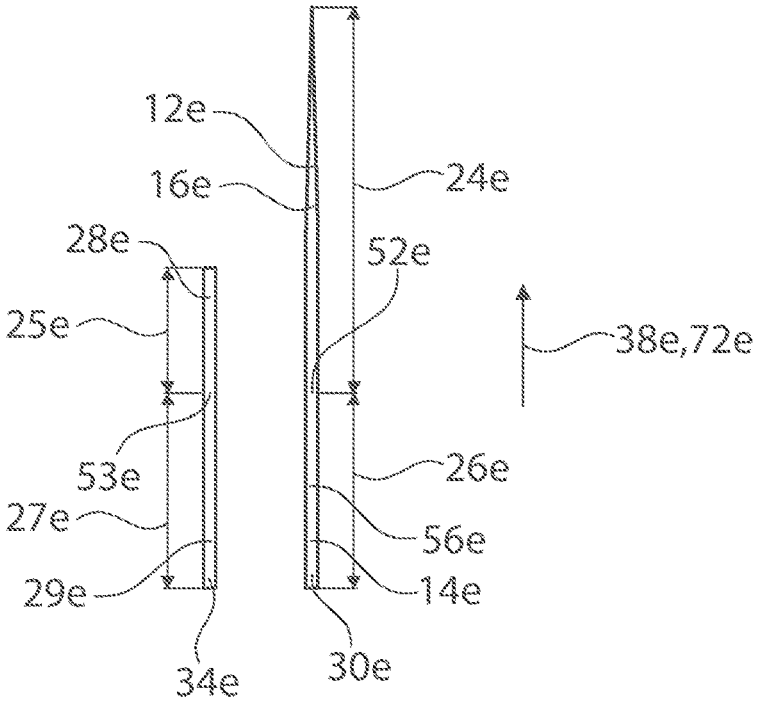
Figure 17:
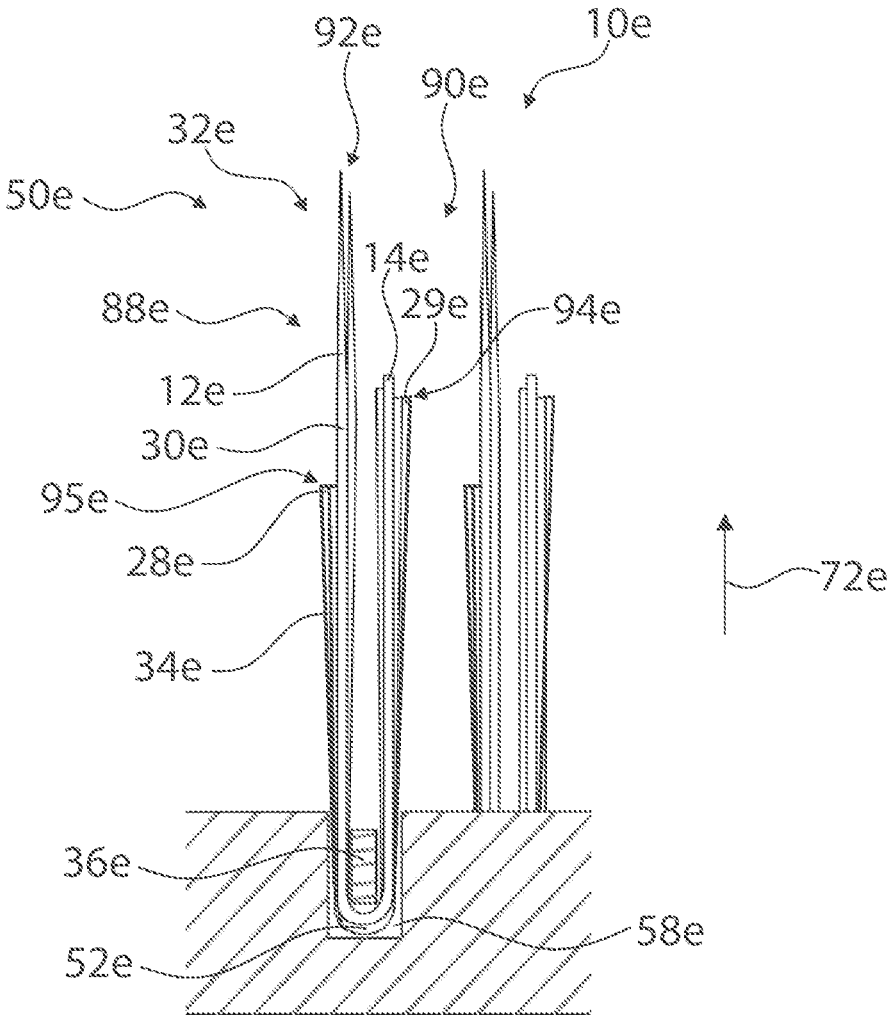
Figure 18:
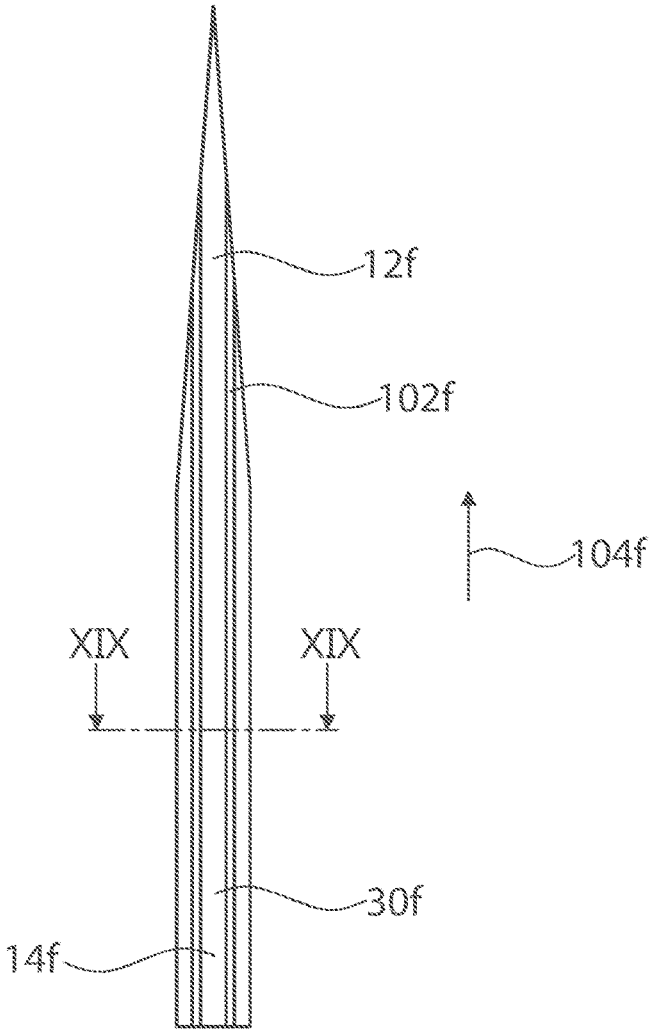
Figure 19:
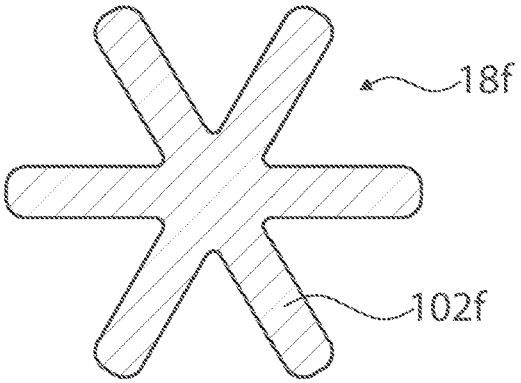
Figure 20:
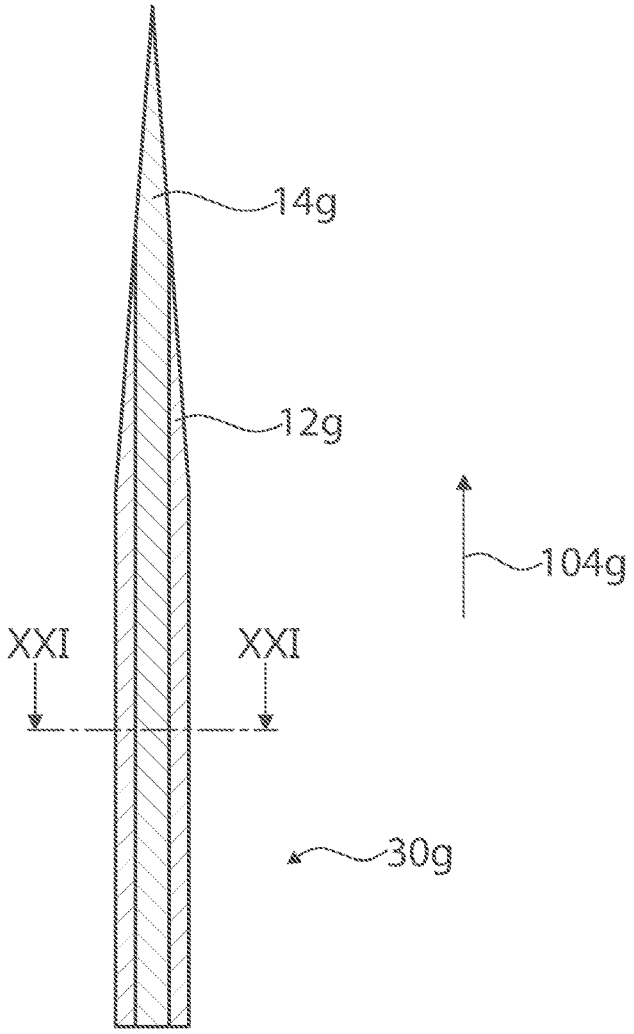
Figure 21:
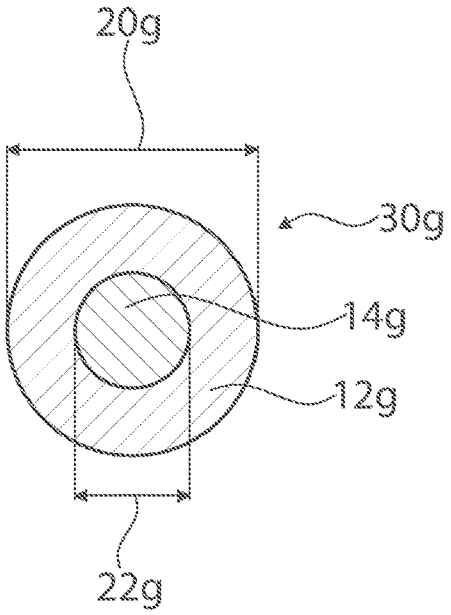
Figure 22:
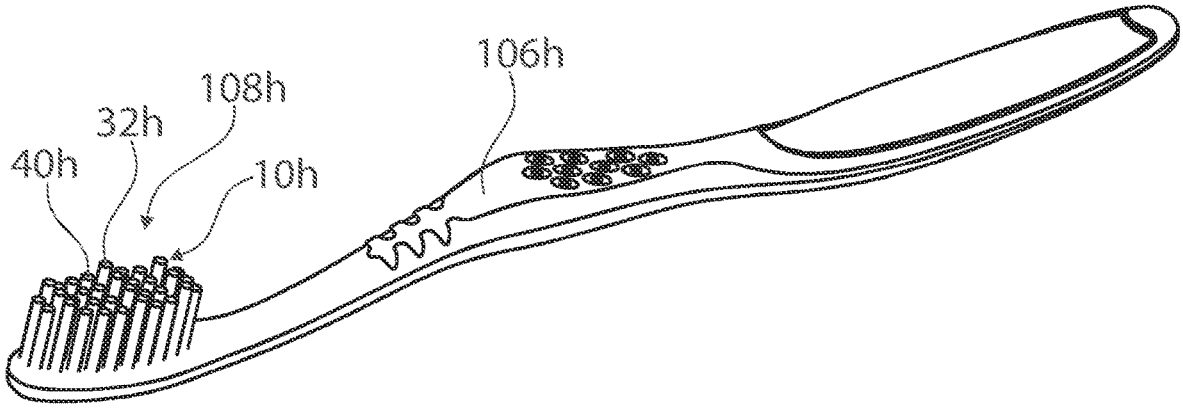
Figure 23:
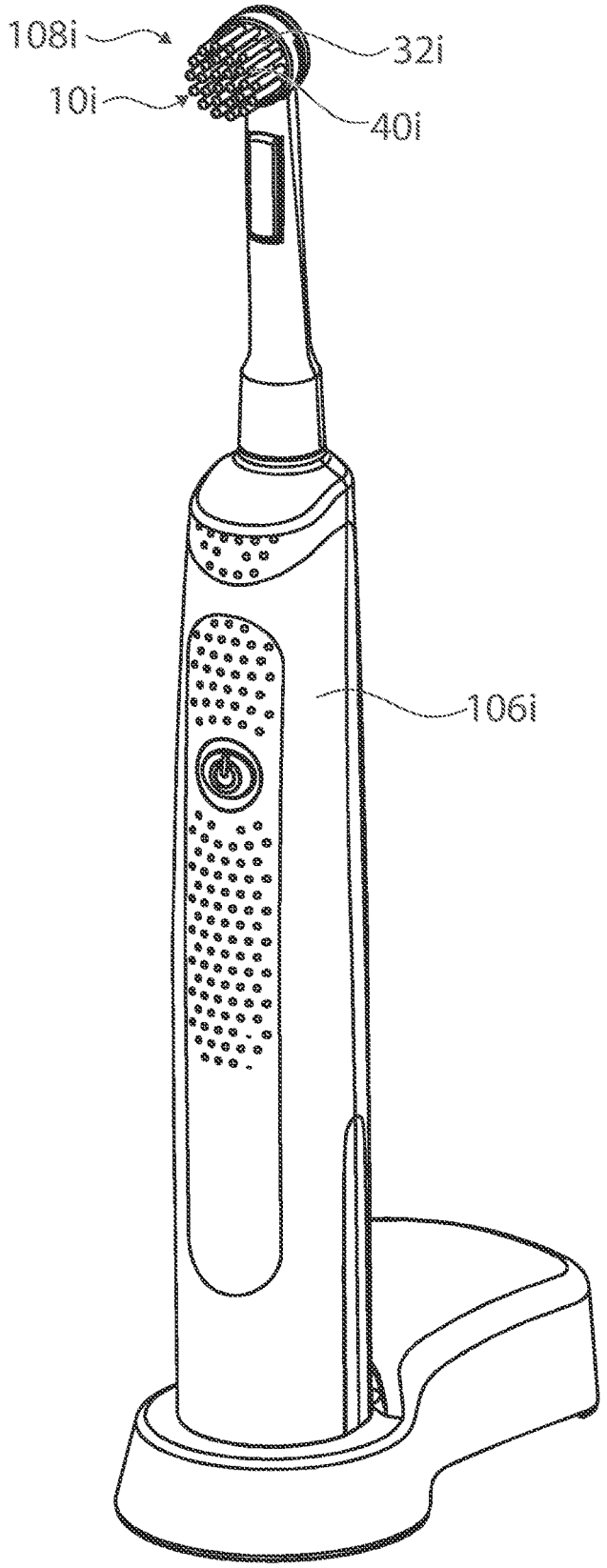
Figure 24:
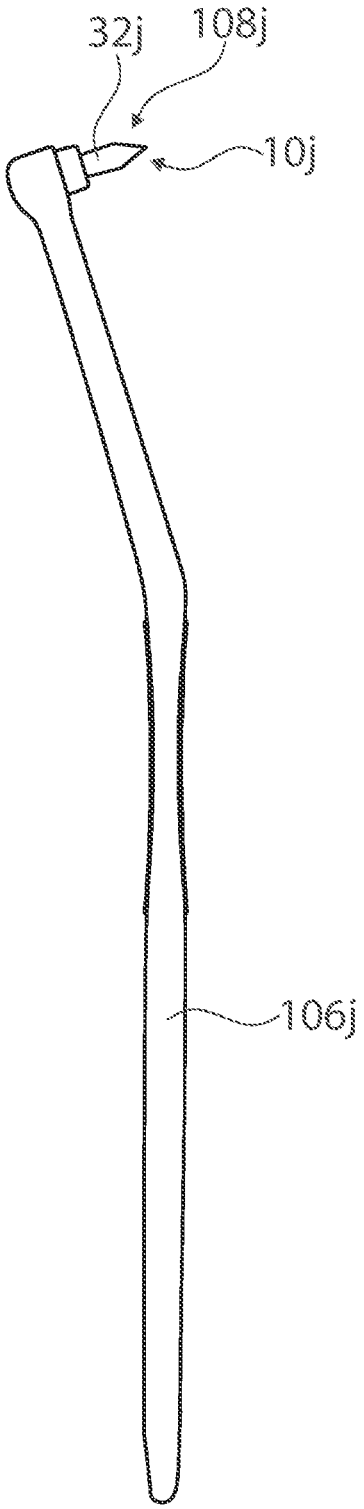
Figure 25:
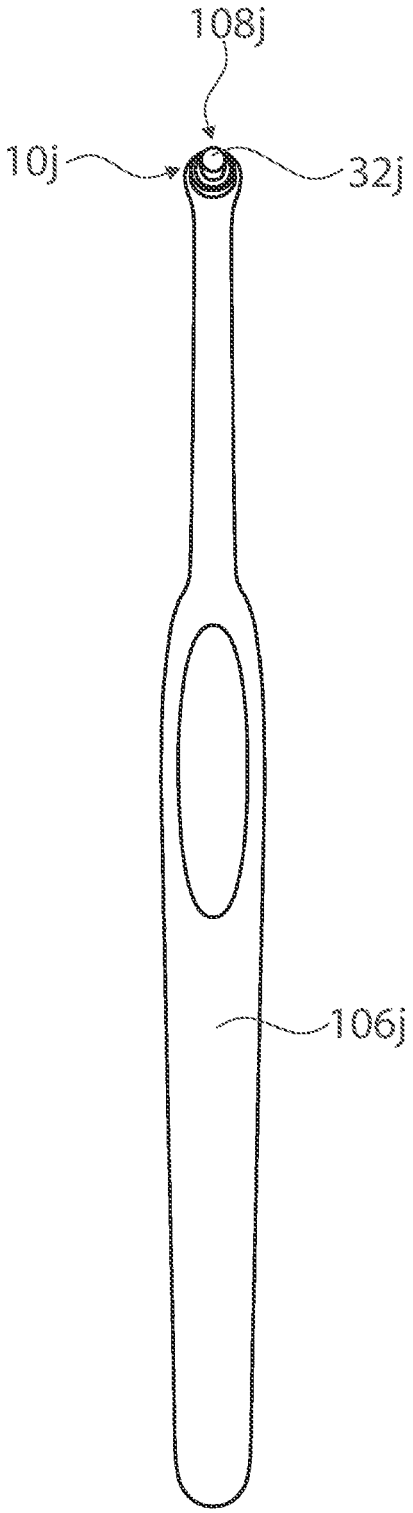
Figure 26:
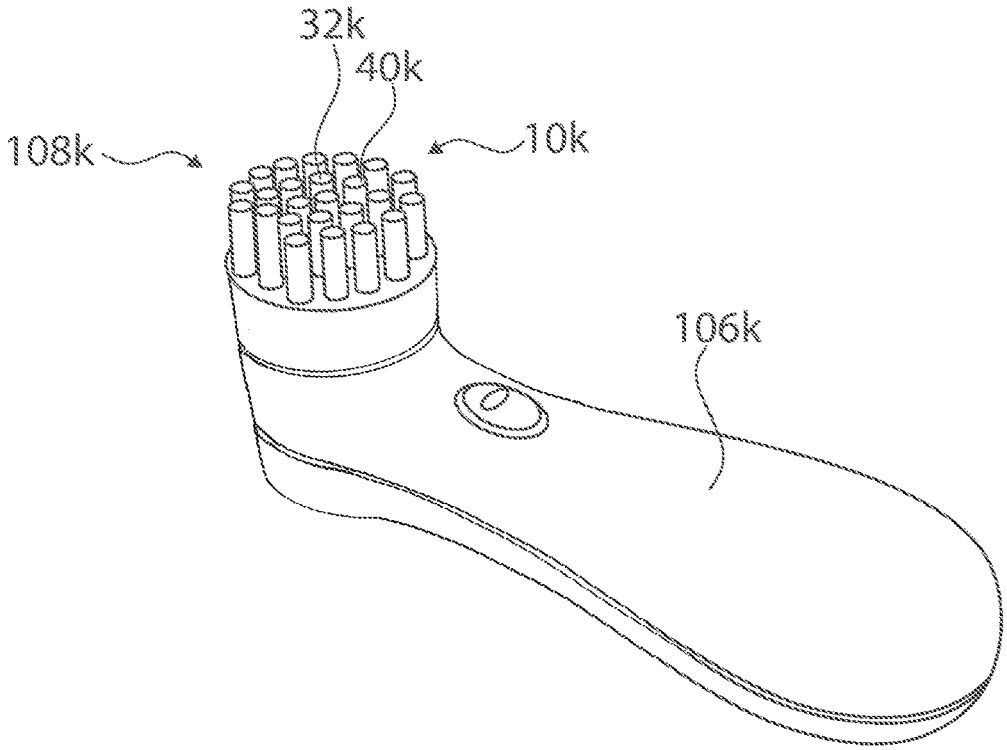

It is shown in:

FIG. 1 a first bristle and a second bristle of a household brush device, in a schematic side view, FIG. 2 a bristle bundle of the household brush device, in a schematic representation, FIG. 3 the bristle bundle of FIG. 2 in a further schematic representation, FIG. 4 a first household brush with the household brush device, in a schematic front view, FIG. 5 the first household brush of FIG. 4 in a schematic side view, FIG. 6 a bristle accommodation region of the household brush device of FIGS. 4 and 5, in a schematic plan view, FIG. 7 a second household brush with a second household brush device, in a schematic side view, FIG. 8 the second household brush of FIG. 7 in a schematic front view, FIG. 9 the second household brush of FIGS. 7 and 8 in a sectional side view, FIG. 10 the second household brush of FIGS. 7 to 9 in a sectional front view, FIG. 11 a brush body with a brush head of the second household brush of FIGS. 7 to 10, in a schematic plan view, FIG. 12 a third household brush with a third household brush device, in a schematic side view, FIG. 13 the third household brush of FIG. 12 in a sectional side view, FIG. 14 the third household brush of FIGS. 12 and 13 in a sectional front view, FIG. 15 a bristle bundle of a fourth household brush device in a schematic representation, FIG. 16 a first bristle and a second bristle of a fifth household brush device, in a schematic side view, FIG. 17 a bristle bundle of the fifth household brush device with bristles of FIG. 16, in a schematic representation, FIG. 18 a bristle of a sixth household brush device in a schematic side view, FIG. 19 a cross section of the bristle of the sixth household brush device of FIG. 18, FIG. 20 a bristle of a seventh household brush device in a sectional side view, and FIG. 21 a cross section of the bristle of the seventh household brush device of FIG. 20, FIG. 22 a hygiene brush with an eighth brush device, in a perspective view, FIG. 23 a second hygiene brush with a ninth brush device in a perspective view, FIG. 24 a third hygiene brush with a tenth brush device in a schematic side view, FIG. 25 the third hygiene brush of FIG. 24 in a schematic plan view, and FIG. 26 a fourth hygiene brush with an eleventh brush device, in a perspective view.

DESCRIPTION OF THE EXEMPLARY EMBODIMENTS

FIG. 1 shows a bristle 30*a* and a further bristle 34*a* of a household brush device 50*a* (cf. for example FIGS. 4 to 6) in a schematic side view.

It is principally conceivable that the household brush device 50*a* is alternatively implemented as a hygiene brush device, in particular an oral-hygiene brush device, e.g. a toothbrush device, an interdental cleaner device, a tongue brush device, or the like. In particular it is conceivable that the household brush device 50*a*, or a corresponding brush device having some or all features analogously to the household brush device 50*a*, is part of a hygiene brush, in particular of an oral-hygiene brush. For the entire following description it is principally conceivable that at least one or a plurality of the described household brush devices is/are implemented in a totally analogous fashion as hygiene brush devices. The shown embodiments as household brush devices are herein to be understood purely by way of examples.

The bristle 30*a* comprises a first bristle end zone 12*a* and a second bristle end zone 14*a*, which is embodied differing from the first bristle end zone 12*a*. The first bristle end zone 12*a* and the second bristle end zone 14*a* are integrally connected in a connection zone 52*a*. In particular, the bristle 30*a* is embodied as an extruded filament. In the present case the first bristle end zone 12*a* and the second bristle end zone 14*a* implement the bristle 30*a*. Furthermore, the bristle 30*a* is in the present case implemented of a synthetic material. A maximum diameter 20*a* of the first bristle end zone 12*a* is in the present case approximately 0.2 mm. The maximum diameter 20*a* of the first bristle end zone 12*a* is in the present case equivalent to a maximum diameter 22*a* of the second bristle end zone 14*a*. The bristle 30*a* has a longitudinal direction 38*a*.

The first bristle end zone 12*a* has a length 24*a* of approximately 65 mm. The first bristle end zone 12*a* has a circle-shaped cross section. The first bristle end zone 12*a* comprises an at least substantially cylinder-shaped region 56*a*. The first bristle end zone 12*a* comprises a tapering region 16*a*, which extends over at least 2% of the length 24*a* of the first bristle end zone 12*a*. In the present case the tapering region 16*a* extends over a length of approximately 25 mm. The tapering region 16*a* is embodied cone-shaped.

The second bristle end zone 14*a* has an at least substantially constant cross section. The second bristle end zone 14*a* is embodied at least substantially cylinder-shaped. The second bristle end zone 14*a* has a length 26*a* of approximately 55 mm. A length of the bristle 30*a* is equivalent to a sum of the length 24*a* of the first bristle end zone 12*a* and the length 26*a* of the second bristle end zone 14*a*.

The further bristle 34*a* comprises a third bristle end zone 28*a*. The third bristle end zone 28*a* is embodied differing from the first bristle end zone 12*a* and from the second bristle end zone 14*a*. In the present case the third bristle end zone 28*a* has a maximum diameter 54*a* which is embodied differing from the maximum diameter 20*a* of the first bristle end zone 12*a* and from the maximum diameter 22*a* of the second bristle end zone 14*a*. Further the maximum diameter 54*a* of the third bristle end zone 28*a* is approximately 0.5 mm. The third bristle end zone 28*a* is embodied of a synthetic material. The third bristle end zone 28*a* may be embodied of a different synthetic material than the first bristle end zone 12*a* and the second bristle end zone 14*a*. The third bristle end zone 28*a* has an at least substantially constant cross section. Furthermore the third bristle end zone 28*a* is embodied at least substantially cylinder-shaped. In the present case the third bristle end zone 28*a* has a length that is equivalent to the length 26*a* of the second bristle end zone 14*a*. In the present case the further bristle 34*a* comprises a fourth bristle end zone 70*a*, which is embodied identically to the third bristle end zone 28*a*.

FIGS. 2 and 3 show a bristle bundle 32*a* of the household brush device 50*a* (cf., for example, FIGS. 4 to 6) in schematic representations, each respectively sectioned through a bundle accommodation 58*a* and non-sectioned. The household brush device 50*a* comprises a brush application region 10*a* (cf. also, for example, FIGS. 4 to 6). The brush application region 10*a* comprises the bristle bundle 32*a*. The bristle bundle 32*a* comprises the bristle 30*a* and the further bristle 34*a*. The bristle bundle 32*a* comprises a plurality of additional bristles and a plurality of additional further bristles, which are not shown in FIGS. 2 and 3 to allow a better overview. The bristle bundle 32*a* comprises 50% bristles 30*a* and 50% further bristles 34*a*. The bristle bundle 32*a* has in the present case a same number of bristles 30*a* and further bristles 34*a*. The bristle bundle 32*a* is fixated in a bundle accommodation 58*a*, which is shown in FIGS. 2 and 3 in a sectioned fashion. The bundle accommodation 58*a* is in the present case embodied cylinder-shaped (cf. also FIG. 3). The bundle accommodation 58*a* is in the present case embodied as a blind hole. The bundle accommodation 58*a* is embodied as a bore. The first bristle end zone 12*a* comprises a bristle fixation zone 64*a*, via which the first bristle end zone 12*a* is fixated. The first bristle end zone 12*a* comprises a bristle application region 68*a*, which is arranged outside the bundle accommodation 58*a*. The bristle fixation zone 64*a* of the first bristle end zone 12*a* and the bristle application region 68*a* of the first bristle end zone 12*a* implement the bristle end zone 12*a*. The bristle fixation zone 64*a* of the first bristle end zone 12*a* and a bristle fixation zone 66*a* of the second bristle end zone 14*a* implement the connection zone 52*a*. The first bristle end zone 12*a* extends from a free end point 60*a* up to a point 62*a* of the bristle fixation zone 64*a* of the bristle end zone 12*a*, which point 62*a* is the farthest away from the free end point 60*a*.

The household brush device 50*a* comprises at least one bristle anchor 36*a*, which fixates the bristle bundle 32*a* off-center with respect to the longitudinal direction 38*a* of the bristle 30*a*. The bristle anchor 36*a* fixates the further bristle 34*a* centrally with respect to a longitudinal direction 72*a* of the further bristle 34*a*. In the present case the bristle anchor 36*a* is embodied of metal. The bristle anchor 36*a* is fixated in the bundle accommodation 58*a*. The bristle anchor 36*a* anchors the bristle 30*a* in the connection zone 52*a*. The bristle anchor 36*a* is in the present case fixated in the bundle accommodation 58*a* by anchor-punching. The first bristle end zone 12*a* is arranged on a first side 88*a* of the bristle anchor 36*a*. The second bristle end zone 14*a* is arranged on a second side 90*a* of the bristle anchor 36*a*. In the present case all first bristle end zones 12*a* of the bristle bundle 32*a* are arranged on the first side 88*a* of the bristle anchor 36*a*. In the present case all second bristle end zones 14*a* are arranged on the second side 90*a* of the bristle anchor 36*a*. On the first side 88*a* and on the second side 90*a* of the bristle anchor 36*a*, an identical number of third bristle end zones 28*a* are arranged. All bristle end zones 14*a*, 28*a* on the second side 90*a* of the bristle anchor 36*a* have at least substantially the same length. The third bristle end zones 28*a* on the first side 88*a* of the bristle anchor 36*a* have substantially the same length as the bristle end zones 14*a*, 28*a* on the second side 90*a* of the bristle anchor 36*a*. The household brush device 50*a* comprises bristle end zones 12*a*, 14*a*, 28*a* with two different lengths. The household brush device 50*a* comprises 25% longer first bristle end zones 12*a* and 75% shorter bristle end zones 14*a*, 28*a*.

FIGS. 4 and 5 show a first household brush 48*a* with the household brush device 50*a* in a schematic side view, respectively in a schematic front view. In the present case the household brush device 50*a* is, exemplarily, part of the household brush 48*a*. However, as mentioned above, it is analogously conceivable that the household brush device 50*a* or an at least partly analogously-implemented hygiene brush device is part of a different household brush or of a hygiene brush, in particular of an oral-hygiene brush. In particular, in these cases dimensions shown exemplarily and/or a number of elements shown may differ from the case of the exemplarily given household brush 48*a*. The first household brush 48*a* is embodied as a broom. The household brush device 50*a* comprises a brush head 74*a*. The brush head 74*a* comprises the brush application region 10*a*. The brush head 74*a* comprises a bristle accommodation region 42*a*. The bristle accommodation region 42*a* comprises the bundle accommodation 58*a*. The bristle accommodation region 42*a* further comprises a plurality of further bundle accommodations, not all of which are provided with reference numerals for the sake of a better overview. The bristle accommodation region 42*a* comprises a plurality of bristle bundles 32*a*, 76*a*, 78*a*, whose main extension directions 80*a*, 82*a*, 84*a* extend at different angles relative to one another. In a first application of the household brush device 50*a*, in particular in case of an application with a low press-on pressure, the first bristle end zones 12*a* implement a first application area 92*a*. The application area 92*a* comes at least partially into contact with a surface that is to be cleaned. The second bristle end zones 14*a* and the third bristle end zones 28*a* implement a second application area 94*a*. In particular in case of an application with a greater pressure, the first bristle end zones 12*a* are bent at least partially. The second application area 94*a* then comes at least partially into contact with the surface that is to be cleaned.

FIG. 6 shows the bristle accommodation region 42*a* on the brush head 74*a* of the brush application region 10*a* in a schematic plan view. To provide a better overview, no bristle bundles are shown in FIG. 6. The bristle accommodation region 42*a* comprises a plurality of bundle accommodations 58*a*, not all of which are given a reference numeral for the sake of a better overview. In each of the bundle accommodations 58*a* respectively one bristle anchor 36*a* is fixated. In the present case the bristle anchors 36*a* are arranged in parallel to one another. It is however also conceivable that the bristle anchors are arranged at different angles to one another.

FIGS. 7 to 21 show six further exemplary embodiments of the invention. The following description and the drawings are substantially restricted to the differences between the exemplary embodiments, wherein regarding identically denominated structural components, in particular regarding structural components having the same reference numerals, the drawings and/or the description of the other exemplary embodiments, inn articular of FIGS. 1 to 6, may also be referred to. To distinguish between the exemplary embodiments, the letter a has been added to the reference numerals of the exemplary embodiment of FIGS. 1 to 6. In the exemplary embodiments of FIGS. 7 to 26, the letter a has been substituted by the letters b to k.

FIGS. 7 to 10 show a second household brush 48*b* with a second household brush device 50*b*. The second household brush 48*b* is embodied as a dishwashing brush. The second household brush device 50*b* comprises a brush application region 10*b* with a bristle accommodation region 42*b*. The bristle accommodation region 42*b* comprises a bristle bundle 32*b* with a first composition of bristles, in particular bristles 30*b* and further bristles 34*b* corresponding to the exemplary embodiment of FIGS. 1 to 6. To give a better overview, FIGS. 7, 8 and 10 schematically show bristle bundles but no individual bristles. The bristle accommodation region 42*b* comprises a further bristle bundle 40*b*, which is embodied differing from the bristle bundle 32*b*. In the present case the further bristle bundle 40*b* comprises a second composition of bristles, which is implemented differing from the first composition of bristles. In the present case the further bristle bundle 40*b* comprises only further bristles 34*b*. The bristle bundles 32*b* implement a first region 96*b*. The first region 96*b* comprises only bristle bundles 32*b*. The further bristle bundles 40*b* implement a second region 98*b*. The second region 98*b* comprises only further bristle bundles 40*b*. The first region 96*b* forms a crown around the second region 98*b*.

The bristle accommodation region 42*b* is curved in at least one spatial direction 44*b*. In the present case the bristle accommodation region 42*b* is curved in three spatial directions 44*b*, 46*b*, 47*b*. In the present case the bristle accommodation region 42*b* is completely, at least not negatively curved. In particular, all partial regions of the bristle accommodation region 42*b* feature a positive Gaussian curvature or zero Gaussian curvature. It is however also conceivable that a bristle accommodation region comprises at least one partial region having a negative Gaussian curvature. The bristle accommodation region 42*b* comprises a plurality of bristle bundles 32*b* and further bristle bundles 40*b*, the main extension directions 80*b*, 81*b* of which extend at different angles to one another. The main extension directions 80*b*, 81*b* include different angles with a surface 100*b* of the bristle accommodation region 42*b*. Each main extension direction of a bristle bundle may be oriented in a different angle, which means that not all main extension directions of one type of bristle bundle are parallel.

FIG. 11 shows a brush body 73*b* with a brush head 74*b* of the second household brush device 50*b*. To give a better overview, no bristle bundles are shown in FIG. 11. The bristle accommodation region 42*b* comprises a plurality of bundle accommodations 58*b*. The bundle accommodations 58*b* each have a bundle accommodation direction extending in parallel to a main extension direction of a bristle bundle that is fixated in the bundle accommodation 58*b*.

FIGS. 12 to 14 show a third household brush 48*c* with a third household brush device 50*c*. The third household brush 48*c* is embodied as a toilet brush. The brush application region is given the reference numeral 10*c*. The household brush device 50*c* comprises a bristle accommodation region 42*c* with a plurality of bristle bundles 32*c*, 76*c*. In the present case the bristle bundles 32*c*, 76*c* have an at least substantially identical composition. In the present case main extension directions 80*c*, 82*c* of the bristle bundles 32*c*, 76*c* respectively extend at the same angle relative to a surface of the bristle accommodation region 42*c*. The main extension directions 80*c*, 82*c* of the bristle bundles 32*c*, 76*c* furthermore extend at different angles to one another.

FIG. 15 shows a bristle bundle 32*d* of a fourth household brush device 50*d* in a schematic representation. The bristle bundle 32*d* comprises only bristles 30*d* with a first bristle end zone 12*d* and a second bristle end zone 14*d*. The household brush device 50*d* comprises a bristle anchor 36*d* fixating the bristle bundle 32*d* off-center with respect to a longitudinal direction of the bristles 30*d*. The household brush device 50*d* comprises 50% first bristle end zones 12*d* and 50% second bristle end zones 14*d*. The household brush device 50*d* comprises identical numbers of first bristle end zones 12*d* and second bristle end zones 14*d*. It is conceivable that the household brush devices 50*a*, 50*b*, 50*c* of the application examples of FIGS. 1 to 14, additionally or alternatively, comprise bristle bundles 32*d*.

FIG. 16 shows a bristle 30*e* and a further bristle 34*e* of a fifth household brush device 50*e* (cf. FIG. 17) in a schematic side view. The bristle 30*e* comprises a first bristle end zone 12*e* and a second bristle end zone 14*e* that is embodied differently from the first bristle end zone 12*e*. The first bristle end zone 12*e* and the second bristle end zone 14 are integrally connected in a connection zone 52*e*. In particular, the bristle 30*e* is embodied as an extruded filament, which is subsequently processed to implement at least the first bristle end zone 12*e*. In the present case the first bristle end zone 12*e* and the second bristle end zone 14*e* embody the bristle 30*e*. Furthermore, the bristle 30*e* is in the present case made of a synthetic material.

The first bristle end zone 12*e* has a length 24*e* of approximately 65 mm. The first bristle end zone 12*e* has a circle-shaped cross section. The first bristle end zone 12*e* comprises an at least substantially cylinder-shaped region 56*e*. The first bristle end zone 12*e* comprises a tapering region 16*e*, which extends over at least 2% of the length 24*e* of the first bristle end zone 12*e*. In the present case the tapering region 16*e* extends over a length of approximately 25 mm. The tapering region 16*e* is embodied cone-shaped.

The second bristle end zone 14*e* has an at least substantially constant cross section. The second bristle end zone 14*e* is implemented at least substantially cylinder-shaped. The second bristle end zone 14*e* has a length 26*e* of approximately 55 mm. A length of the bristle 30*e* corresponds to a sum of the length 24*e* of the first bristle end zone 12*e* and the length 26*e* of the second bristle end zone 14*e*. The bristle 30*e* has a longitudinal direction 38*e*.

The further bristle 34*e* comprises a third bristle end zone 28*e* and a fourth bristle end zone 29*e* that is embodied differently than the third bristle end zone 28*e*. The third bristle end zone 28*e* and the fourth bristle end zone 29*e* are furthermore embodied differently than the first bristle end zone 12*e* and the second bristle end zone 14*e*. The third bristle end zone 28*e* and the fourth bristle end zone 29*e* are integrally connected in a connection zone 53*e*. In particular, the further bristle 34*e* is embodied as an extruded filament. In the present case the third bristle end zone 28*e* and the fourth bristle end zone 29*e* implement the further bristle 34*e*. Furthermore, the further bristle 34*e* is in the present case made of a synthetic material.

The third bristle end zone 28*e* has an at least substantially constant cross section. The third bristle end zone 28*e* is embodied at least substantially cylinder-shaped. The third bristle end zone 28*e* has a length 25*e* of approximately 45 mm. The fourth bristle end zone 29*e* has an at least substantially constant cross section. The fourth bristle end zone 29*e* is embodied at least substantially cylinder-shaped. The fourth bristle end zone 29*e* has a length 27*e* of approximately 55 mm. In particular, the fourth bristle end zone 29*e* and the second bristle end zone 14*e* have at least substantially identical lengths. A length of the further bristle 34*e* is equivalent to a sum of the length 25*e* of the third bristle end zone 28*e* and the length 27*e* of the fourth bristle end zone 29*e*. The further bristle 34*e* has a longitudinal direction 72*e*.

FIG. 17 shows a bristle bundle 32*e* of the fifth household brush device 50*e* in a schematic representation. The household brush device 50*e* comprises a brush application region 10*e*. The brush application region 10*e* comprises the bristle bundle 32*e*. The bristle bundle 32*e* comprises the bristle 30*e* and the further bristle 34*e*. The bristle bundle 32*e* comprises a plurality of additional bristles and a plurality of additional further bristles, which are not shown in FIG. 17 for the sake of a better overview. The bristle bundle 32*e* comprises 50% bristles 30*e* and 50% further bristles 34*e*. The bristle bundle 32*e* comprises in the present case identical numbers of bristles 30*e* and further bristles 34*e*. The bristle bundle 32*e* is fixated in a bundle accommodation 58*e*, which is shown in FIG. 17 in a sectional representation. The bundle accommodation 58*e* is in the present case embodied cylinder-shaped. The bundle accommodation 58*e* is in the present case implemented as a blind hole. The bundle accommodation 58*e* is implemented as a bore.

The household brush device 50*e* comprises at least one bristle anchor 36*e*, which fixates the bristle bundle 32*e* off-center with respect to the longitudinal direction 38*e* of the bristle 30*e*. The bristle anchor 36*e* fixates the further bristle 34*e* off-center with respect to the longitudinal direction 72*e* of the further bristle 34*e*. In the present case the bristle anchor 36*e* is made of metal. The bristle anchor 36*e* is fixated in the bundle accommodation 58*e*. The bristle anchor 36*e* anchors the bristle 30*e* in the connection zone 52*e*. The bristle anchor 36*e* anchors the further bristle 34*e* in the connection zone 53*e*. The bristle anchor 36*e* is in the present case fixated in the bundle accommodation 58*e* by anchor punching. The first bristle end zone 12*e* is arranged on a first side 88*e* of the bristle anchor 36*e*. The second bristle end zone 14*e* is arranged on a second side 90*e* of the bristle anchor 36*e*.

In the present case all first bristle end zones 12*e* of the bristle bundle 32*e* are arranged on the first side 88*e* of the bristle anchor 36*e*. In the present case all second bristle end zones 14*e* are arranged on the second side 90*e* of the bristle anchor 36*e*. The third bristle end zone 28*e* is arranged on the first side 88*e* of the bristle anchor 36*e*. The fourth bristle end zone 29*e* is arranged on the second side 90*e* of the bristle anchor 36*e*. In the present case all third bristle end zones 28*e* of the bristle bundle 32*e* are arranged on the first side 88*e* of the bristle anchor 36*e*. In the present case all fourth bristle end zones 29*e* of the bristle bundle 32*e* are arranged on the second side 90*e* of the bristle anchor 36*e*. All bristle end zones 14*e*, 29*e* on the second side 90*e* of the bristle anchor 36*e* have at least substantially the same length. The bristle end zones 12*e*, 28*e* on the first side 88*e* of the bristle anchor 36*e* feature two different lengths, which differ from the length on the second side 90*e*. The bristle end zones 12*e*, 14*e*, 28*e*, 29*e* form three application surfaces 92*e*, 94*e*, 95*e*. The application surfaces 92*e*, 94*e*, 95*e* are located at different heights relative to the bundle accommodation 58*e*. The application surface 92*e* comprises 25% of all bristle end zones of the bristle bundle 32*e*. The application surface 94*e* comprises 50% of all bristle end zones of the bristle bundle 32*e*. The application surface 95*e* comprises 25% of all bristle end zones of the bristle bundle 32*e*. In case of other compositions of the bristle bundle of bristles and further bristles, a proportion of the numbers of bristle end zones of the application surface 92*e* and the application surface 95*e* changes. For other compositions of the bristle bundle of bristles and further bristles, the proportion of numbers of bristle end zones of the application surface 94*e* remains unchanged.

FIGS. 18 and 19 show a bristle 30*f* of a sixth household brush device (not shown) in a schematic side view and in a sectional view along the section line XIX-XIX of FIG. 18. The bristle 30*f* comprises a first bristle end zone 12*f* and a second bristle end zone 14*f*. The first bristle end zone 12*f* has a cross section with at least one concave region 18*f*. The first bristle end zone 12*f* has a sinuate cross section. The first bristle end zone 12*f* comprises at least one lamella 102*f*, which extends along a main extension direction 104*f* of the first bristle end zone 12*f*. In the present case the first bristle end zone 12*f* comprises six lamellae 102*f*. The lamellae 102*f* peter out over the region of tapering, such that the pointed end of the bristle 30*f* has no lamellae. It is however also conceivable that the pointed end comprises at least portions of lamellae. The first bristle end zone 12*f* is made of a synthetic material. The first bristle end zone 12*f* is advantageously capable of taking up large quantities of water, in particular in the concave region 18*f*, wherein the water in particular does not enter the bristle end zone 12*f*.

FIGS. 20 and 21 show a bristle 30*g* of a seventh household brush device 50*g* (not shown) in a schematic side view and in a sectional view along the section line XXI-XXI of FIG. 20. The bristle 30*g* comprises a first bristle end zone 12*g* and a second bristle end zone 14*g*. The first bristle end zone 12*g* and the second bristle end zone 12*g* are connected along a main extension direction 104*g* of the first bristle end zone 12*g*. In the present case the first bristle end zone 12*g* and the second bristle end zone 14*g* are connected integrally. The first bristle end zone 12*g* and the second bristle end zone 14*g* are in the present case produced in a co-extrusion procedure. The bristle 30*g* is in the present case produced in a co-extrusion procedure. The first bristle end zone 12*g* encompasses the second bristle end zone 14*g* at least partly. In the present case the first bristle end zone 12*g* implements a shell. In the present case the second bristle end zone 14*g* implements a core. The first bristle end zone 12*g* and the second bristle end zone 14*g* are realized of different materials. In the present case the first bristle end zone 12*g* and the second bristle end zone 14*g* are realized of different synthetic materials. The first bristle end zone 12*g* has a greater hardness than the second bristle end zone 14*g*. It is however also conceivable that the first bristle end zone 12*g* has a smaller hardness than the second bristle end zone 14*g*. A maximum diameter 20*g* of the first bristle end zone 12*g* differs from a maximum diameter 22*g* of the second bristle end zone 14*g*.

In the following four exemplary embodiments of hygiene brushes are shown. The described household brush devices may be applied in hygiene brushes, in an analogous or modified implementation. In particular, it is principally possible to transfer characteristics of shown household brush devices, shown brush devices and/or shown hygiene brush devices to each other and/or to selectively or entirely combine such characteristics. In particular, household brushes shown may be realized as hygiene brushes and vice versa.

FIG. 22 shows a hygiene brush 106*h* with an eighth brush device 108*h* in a perspective view. The eighth brush device 108*h* is implemented as a hygiene brush device. The hygiene brush 106*h* is in the present case embodied as a toothbrush. The eighth brush device 108*h* comprises a brush application region 10*h* comprising at least one first bristle end zone (not shown in detail) and at least one second bristle end zone (not shown in detail), wherein the second bristle end zone is implemented differently than the first bristle end zone. The eighth brush device 108*h* may of course also comprise a greater number of differently implemented bristle end zones and/or any required proportion of the numbers of differing bristle end zones.

The eighth brush device 108*h* comprises a plurality of first bristle bundles 32*h* and a plurality of second bristle bundles 40*h*. As has been described above, the first bristle bundles 32*h* and/or the second bristle bundles 40*h* may comprise bristles with differing or identical bristle end zones and/or may differ regarding a composition of first bristles and second bristles and/or bristle end zones. In the present case the first bristle bundles 32*h* have a different length than the second bristle bundles 40*h*. The bristle bundles 32*h*, 40*h* may furthermore differ regarding any other characteristics, as is in particular described in the other exemplary embodiments. It is moreover conceivable that at least some of the bristle bundles 32*h*, 40*h* are arranged at angles to one another, e.g. in the way of an X position.

FIG. 23 shows a second hygiene brush 106*i* with a ninth brush device 108*i* in a perspective view. The ninth brush device 108*i* is embodied as a hygiene brush device. The second hygiene brush 106*i* is embodied as an electrical tooth brush. The ninth brush device 108*i* comprises a brush application region 10*i* comprising at least one first bristle end zone (not explicitly shown) and at least one second bristle end zone (not explicitly shown), the second bristle end zone being embodied differing from the first bristle end zone. The ninth brush device 108*i* may of course also comprise a greater number of differently embodied bristle end zones and/or any ratio of the numbers of different bristle end zones.

The ninth brush device 108*i* comprises a plurality of first bristle bundles 32*i* and a plurality of second bristle bundles 40*i*. As has been described previously, the first bristle bundles 32*i* and the second bristle bundles 40*i* may comprise bristles with different or identical bristle end zones and/or may differ regarding a composition of first bristles and second bristles and/or bristle end zones. It is, for example, possible that bristle bundles, which may be embodied identically or differently, are arranged on different concentric circles. It is further conceivable that different or identical bristle bundles are arranged in certain patterns, e.g. alternatingly and/or on corners of polygons and/or in radially running rows, or the like. The bristle bundles 32*i*, 40*i* may furthermore differ in any characteristics, as is in particular described regarding the other exemplary embodiments. Moreover it is conceivable that at least some of the bristle bundles 32*i*, 40*i* are arranged at angles to one another, e.g. in the way of an X position.

FIG. 24 shows a third hygiene brush 106*j* with a tenth brush device 108*j* in a perspective view. FIG. 25 shows the third hygiene brush 106*j* in a schematic plan view. The tenth brush device 108*j* is embodied as a hygiene brush device. The third hygiene brush 106*j* is embodied as a dental cleaning brush. In the present case the third hygiene brush 106*j* is embodied as a single-tuft toothbrush, in particular as a single-tuft interdental cleaner. The tenth brush device 108*j* comprises a brush application region 10*j* comprising at least one first bristle end zone (not explicitly shown) and at least one second bristle end zone (not explicitly shown), the second bristle end zone being implemented differently than the first bristle end zone. The tenth brush device 108*j* may of course also comprise a greater number of differently embodied bristle end zones and/or any ratio of the numbers of different bristle end zones.

The tenth brush device 108*j* comprises a single bristle bundle 32*j*. As has been described previously, the bristle bundle 32*j* may comprise different bristles and/or different bristle end zones. In the present case the bristle bundle 32*j* is pointed. It is however also conceivable that the bristle bundle 32*j* is rounded-off. Individual bristles of the bristle bundle 32*j* may, for example, be shortened subsequently to an anchoring of the bristles, for the purpose of defining a geometry of the bristle bundle 32*j*. It is also conceivable that, prior to anchoring, bristles of different lengths are used. It is further conceivable that the bristle bundle 32*j* comprises different bristles and/or bristle end zones, which are arranged in a certain pattern, e.g. on concentric circles and/or on radially running lines and/or on polygons, in particular regular polygons, in particular corners of such polygons, and/or on spiral paths, or the like.

FIG. 26 shows a fourth hygiene brush 106*k* with an eleventh brush device 108*k* in a perspective view. The eleventh brush device 108*k* is implemented as a hygiene brush device. The fourth hygiene brush 106*k* is embodied as a face brush. In the present case the fourth hygiene brush 106*k* is embodied as an electrical face brush. The eleventh brush device 108*k* comprises a brush application region 10*k* having at least one first bristle end zone (not explicitly shown) and at least one second bristle end zone (not explicitly shown), the second bristle end zone being implemented differing from the first bristle end zone.

The eleventh brush device 108*k* may of course also comprise a greater number of differently embodied bristle end zones and/or any ratio of the numbers of different bristle end zones.

The eleventh brush device 108*k* comprises a first bristle bundle 32*k* and a second bristle bundle 40*k*. In the present case the eleventh brush device 108*k* comprises a plurality of bristle bundles 32*k*, 40*k*. The bristle bundles 32*k*, 40*k* may differ regarding a composition of differently and/or identically implemented bristles and/or bristle end zones, or may be implemented at least substantially identically, analogously to the above exemplary embodiments. Furthermore the bristle bundles 32*k*, 40*k* may be arranged at an angle to one another.

In particular a hygiene brush device according to the invention and/or a hygiene brush according to the invention may be used for bodycare, in particular oral care. Applications are conceivable, for example, in the fields of prophylaxis, in particular dental prophylaxis, dental cleaning, dental care, tongue cleaning, oral-space care and the like. Moreover a household brush according to the invention may be used in particular for cleaning, e.g. household cleaning, preferably floor cleaning, stairs cleaning, ceiling cleaning and/or for cleaning places which are difficult to access and/or narrow and/or angular, e.g. fissures and/or seams, heating elements, installations of conducts, or the like.

The invention claimed is:

1. A household brush or hygiene brush device comprising:

at least one brush head, which comprises a brush application region with at least one first bristle end zone and at least one second bristle end zone, wherein the brush application region comprises at least one bristle accommodation region with a plurality of bristle bundles and/or further bristle bundles, wherein the bristle accommodation region comprises a plurality of bundle accommodations, in which, at least in a mounted state, respectively one bristle bundle and/or further bristle bundle is anchored, wherein the bristle bundle is embodied by a plurality of first bristles and a plurality of further bristles, wherein the further bristle bundle comprises only further bristles, wherein the first bristle end zone implements the first bristle and the second bristle end zone implements the further bristle, wherein the second bristle end zone is implemented differing from the first bristle end zone, wherein the bristle bundle comprises a first number of first bristles and comprises a second number of further bristles, wherein the first number is different from the second number, wherein the first bristle end zone comprises a tapering region and the second bristle end zone has an at least substantially constant cross section, wherein the first number is greater than the second number, wherein the plurality of first bristles and a plurality of further bristles are glued to the brush head or anchored to the brush head by partial melting several ends of the bristles, and wherein the brush application region comprises at least one first region with a plurality of bristle bundles and at least one second region with a plurality of further bristle bundles, the first region forming a crown around the second region.

2. The household brush or hygiene brush device according to claim 1, wherein the tapering region features, completely or at least section-wise, a coloring that differs from the respectively remaining bristle end zone.

3. The household brush or hygiene brush device according to claim 1, wherein a maximum diameter of the first bristle end zone differs from a maximum diameter of the second bristle end zone by at least 70%.

4. The household brush or hygiene brush device according to claim 1, wherein the tapering region extends over at least 25% of a length of the corresponding bristle end zone.

5. The household brush or hygiene brush device according to claim 1, wherein the tapering region is produced by chemical etching and/or mechanical grinding, in particular during a subsequent processing of an extrusion blank or of the cut extrusion blank.

6. The household brush or hygiene brush device according to claim 1, wherein the bristles are embodies as extruded filaments, for which polyamide (PA) or polyester, like pure polybutylene terephthalate (PBT), or a mixture of polyethylene terephthalate (PET) and polyester (PBT) are used.

7. The household brush or hygiene brush device according to claim 1, wherein the brush head comprises a bristle accommodation region, wherein the bristle accommodation region comprises a plurality of bundle accommodations, wherein the surface area of a bundle accommodation is 40 mm2 to 100 mm2.

8. The household brush or hygiene brush device according to claim 1, wherein the brush head comprises a bristle accommodation region, wherein the surface area of a bristle accommodation region is 100 mm2 to 600 mm2.

9. The household brush or hygiene brush device according to claim 1, wherein the ratio of the surface area of the bundle accommodation to a surface area of the bristle accommodation region, which the bristle bundles and the further bristle bundles are introduced in, is in total from 10% to 50%.

10. The household brush or hygiene brush device according to claim 1, wherein the bristle bundles are fixated to a carrier body without using an anchor, in particular by Anchor Free Tufting (AFT) procedure of Boucherie N.V. of Izegem, Belgium.

11. The household brush or hygiene brush device according to claim 1, wherein the brush head comprises a bristle accommodation region, wherein the bristle accommodation region comprises a plurality of bundle accommodations, wherein the bundle accommodations are produced in/during an injection-molding procedure together with the brush head.

12. The household brush or hygiene brush device according to claim 1, wherein the household brush or hygiene brush device is also operable motorically, wherein this constitutes an electrical drive with a velocity of 1,000-30,000 rpm.

13. The household brush or hygiene brush device according to claim 12, wherein a drive of the household brush or hygiene brush device generates an oscillating rotational movement around an axis that is parallel to the bristle accommodation region or a partial region thereof with a maximum rotation angle of 50°.

14. The household brush or hygiene brush device according to claim 1, wherein the brush application region comprises at least one first region with a plurality of bristle bundles and at least one second region with a plurality of further bristle bundles, wherein the first region encompasses the second region at least partially.

15. The household brush or hygiene brush device according to claim 1, wherein the first region encloses the second region in at least four spatial directions perpendicular to each other.

16. An electrical household brush or hygiene brush device, in particular an electrical toothbrush, comprising:

at least one brush head, which comprises a bristle accommodation region and a brush application region with at least one first bristle end zone and at least one second bristle end zone, a plurality of bristle bundles, a plurality of further bristle bundles, wherein the bristle bundle is embodied by a plurality of bristles and a plurality of further bristles, wherein the further bristle bundle comprises only further bristles, wherein the bristle accommodation region comprises a plurality of bundle accommodations, wherein the bristle accommodation region further comprises a plurality of further bundle accommodations, wherein the bundle accommodations are arranged in the brush head, wherein the bristle bundles are fixated in the bundle accommodations, wherein the first bristle end zone and the second bristle end zone each implement a bristle and are respectively fixated in a bristle fixation zone via partially melting a plurality of bristle ends, wherein the bristle fixation zone is arranged at least partly in a bundle accommodation of the brush application region, wherein the second bristle end zone is implemented differing from the first bristle end zone, wherein the further bristle bundle has, relative to the bristle bundle, a different shape of the bundle accommodation, and wherein the bristle accommodation region comprises a plurality of differently embodied bundle accommodations, wherein at least one of the bundle accommodations is crescent-shaped and at least one other of the bundle accommodations are oval/elliptic.

17. The household brush or hygiene brush device according to claim 16, wherein the bundle accommodations and further bundle accommodations are arranged in concentric circles.

18. The household brush or hygiene brush device according to claim 16, wherein at least one of the bristle end zones comprises at least one tapering region.

19. The household brush or hygiene brush device according to claim 16, wherein one of the bristle end zones comprises a tapering region and the other bristle end zone has an at least substantially constant cross section.

* * * * *